US012758822B2

(12) United States Patent
Pritchett

(10) Patent No.: US 12,758,822 B2
(45) Date of Patent: Oct. 13, 2026

(54) WEIGHTLIFTING APPARATUS

(71) Applicant: Coulter Ventures, LLC., Columbus, OH (US)

(72) Inventor: Martin Pritchett, Columbus, OH (US)

(73) Assignee: Coulter Ventures, LLC., Columbus, OH (US)

( * ) Notice: Subject to any disclaimer, the term of this patent is extended or adjusted under 35 U.S.C. 154(b) by 325 days.

(21) Appl. No.: 18/388,966

(22) Filed: Nov. 13, 2023

(65) Prior Publication Data

US 2024/0157195 A1 May 16, 2024

Related U.S. Application Data

(60) Provisional application No. 63/424,640, filed on Nov. 11, 2022.

(51) Int. Cl.
*A63B 23/12* (2006.01)
*A63B 21/00* (2006.01)

(52) U.S. Cl.
CPC ..... *A63B 23/1227* (2013.01); *A63B 21/4033* (2015.10); *A63B 2225/09* (2013.01)

(58) Field of Classification Search
CPC ..... A63B 21/0724; A63B 21/078; A63B 21/4033; A63B 21/4035; A63B 23/1227; A63B 2225/09; A63B 2225/093
See application file for complete search history.

(56) References Cited

U.S. PATENT DOCUMENTS 4,620,701 A * 11/1986 Mojden ..... A63B 3/00 482/142
5,417,628 A 5/1995 Vanderbleek
5,688,216 A 11/1997 Mauriello
(Continued)

FOREIGN PATENT DOCUMENTS

GB 6197814 S 3/2022
GB 6303593 8/2023

OTHER PUBLICATIONS

Product listing for Rogue Monster Lite Matador, From: https://www.roguefitness.com/rogue-monster-lite-matador, dated Jun. 14, 2014, accessed Feb. 20, 2022.
(Continued)

*Primary Examiner* — Joshua Lee
(74) *Attorney, Agent, or Firm* — Banner & Witcoff, Ltd.

(57) ABSTRACT

A weightlifting apparatus includes a base for connection to a weight rack, and a first arm and a second arm extending outward on opposite lateral sides. The first arm has a mounting hole extending inward from the front side of the first arm and a plurality of positioning holes around the first mounting hole. A handle is adjustably connectable to the first arm to extend outward from the first arm and includes a connector and a grip member extending outward from the connector. The connector has a shaft extending away from the grip member and a projection alongside the shaft, and the handle is adjustably connectable to the first arm by the shaft being received in the mounting hole. The projection can be received in any of the positioning holes to mount the handle in a plurality of different rotational positions, in which the grip member is oriented differently.

27 Claims, 16 Drawing Sheets

(56) References Cited

U.S. PATENT DOCUMENTS

| | | | | |
|---|---|---|---|---|
| 6,217,483 | B1 * | 4/2001 | Kallassy | A63B 21/068 482/41 |
| 7,837,598 | B1 * | 11/2010 | Boozel, Jr. | A63B 23/03525 482/38 |
| D633,961 | S | 3/2011 | Loew et al. | |
| 9,427,611 | B1 | 8/2016 | Balentine | |
| 9,452,308 | B2 | 9/2016 | Lentz et al. | |
| 10,376,727 | B2 * | 8/2019 | Fitzpatrick | A63B 23/1227 |
| D906,449 | S | 12/2020 | Garcia | |
| D931,958 | S | 9/2021 | Pritchett et al. | |
| D1,014,668 | S | 2/2024 | Valenzuela | |
| D1,017,740 | S | 3/2024 | Carrington, III et al. | |
| D1,055,185 | S | 12/2024 | Pritchett | |
| D1,065,380 | S | 3/2025 | Pritchett | |
| 12,496,483 | B2 * | 12/2025 | Miller | A63B 1/00 |
| 2012/0329626 | A1 | 12/2012 | Meredith et al. | |
| 2017/0354838 | A1 * | 12/2017 | Fitzpatrick | A63B 1/00 |
| 2018/0142832 | A1 | 5/2018 | Inouye | |
| 2019/0247701 | A1 | 8/2019 | Sergakis et al. | |
| 2022/0203153 | A1 | 6/2022 | Sergakis et al. | |
| 2024/0157195 | A1 | 5/2024 | Pritchett | |
| 2024/0359049 | A1 | 10/2024 | Pritchett | |

OTHER PUBLICATIONS

Product listing for Rogue Monster Matador, From: <https://www.roguefitness.com/rogue-monster-matador>, dated Jun. 14, 2014, accessed Feb. 20, 2022.

Product listing for Rogue Infinity Matador, From :<https://www.roguefitness.com/rogue-monster-matador>, dated Aug. 3, 2020, accessed Feb. 20, 2022.

"Mutant Metals "; Instagram; retrieved Feb. 16, 2023; published Apr. 27, 2021; URL: <https://www.instagram.com/p/COLxvuWgBKk/ >.

"Primalarmor"; Instagram; retrieved Feb. 16, 2023; published Oct. 29, 2022; URL: <https://www.instagram.com/p/CKTSVLPudfn/ >.

The Ultimate Dip Attachment; product listing; https://web.archive.org/web/20210521174630/https:/mutantmetals.com/products/p/cfnu97n1rgnzjbpfuvh4ruempgpsvo; 4 pages; May 21, 2021; downloaded Nov. 14, 2023.

Ultimate Dip Attachment; <https://www.youtube.com/watch?v=Y58UqdLhs1k> (dated Jan. 10, 2021).

Rogue, Rogue Velocidor, published Apr. 2023 [online]. Retrieved from internet (Date: Mar. 25, 2024), https://www.roguefitness.com/rogue-velocidor (Year: 2023).

Mikola, Dip Bar Attachment, published on Oct. 18, 2023 [online]. Retrieved from internet (Date: Mar. 25, 2024), https://www.amazon.com/Mikolo-Attachment-Mounted-Weight-Capacity/dp/B0CL9HV87Y/?th=1 (Year: 2023).

Garage Gym Reviews, Rogue Velocidor Dip Attachment Review, published on Apr. 14, 2023 [online]. Retrieved from internet (Date: Mar. 25, 2024), https://www.youtube.com/watch?v=DI5b1Q4UBOO (Year: 2023).

Rogue, Mutant Metals Ultimate Dip Attachment (UDA), published on Jun. 2023 [online]. Retrieved from internet (Date: Jun. 12, 2024), https://www.roguefitness.com/mutant-metals-ultimate-dip-attachments-uda (Year: 2023).

Garage Gym Gainz, Mutant Metals VS Rogue Fitness Dip Attachment, published on Jan. 13, 2021 [online]. Retrieved from internet (Date: Jun. 12, 2024), https://www.youtube.com/watch?v=p9xvw9Nu0IQ (Year: 2021).

* cited by examiner

WEIGHTLIFTING APPARATUS

CROSS-REFERENCE TO RELATED APPLICATION

This application is a non-provisional of, and claims priority to, U.S. Provisional Application No. 63/424,640, filed Nov. 11, 2022, which is incorporated herein by reference in its entirety.

FIELD OF THE INVENTION

This disclosure relates to a weightlifting apparatus, and more specifically to a weightlifting attachment, e.g., a dip apparatus, having handles that are adjustable among a plurality of different positions.

BACKGROUND

A large number of weightlifting apparatuses exist that facilitate a user performing a "dip" exercise, in which a user grips two handles that are spaced apart and lowers and raises their body between the handles. Such apparatuses may be stand-alone equipment or attachments for connection to another piece of equipment, such as a weight rack. However, existing dip apparatuses typically have fixed handles that are not adjustable to different positions, limiting the variety of use of the apparatus.

The present disclosure is provided to address this need and other needs in existing dip apparatuses and similar weightlifting attachments and apparatuses. A full discussion of the features and advantages of the present invention is deferred to the following detailed description, which proceeds with reference to the accompanying drawings.

BRIEF SUMMARY

General aspects of the present disclosure relate to a weightlifting apparatus having handles that are adjustably connected to a base in a plurality of different positions, including different lateral positions and/or different rotational positions. One such example of a weightlifting apparatus is a dip assembly that includes a base having a mounting portion configured for mounting to a vertical beam of a weight rack and two arms extending outwardly, with two handles adjustably connectable to the two arms for use in a dip exercise.

Aspects of the disclosure relate to a weightlifting apparatus that includes a base having a mounting portion configured for connection to a vertical frame member of a weight rack or other supporting structure, a first arm and a second arm extending outward on opposite lateral sides of the mounting portion, and a connecting portion connecting the first and second arms to the mounting portion. The first arm has a first mounting hole extending inward from a front side of the first arm and a plurality of first positioning holes extending inward from the front side of the first arm and positioned at different locations around the first mounting hole, and the second arm has a second mounting hole extending inward from a front side of the second arm and a plurality of second positioning holes extending inward from the front side of the second arm and positioned at different locations around the second mounting hole. The apparatus also includes a first handle connected to the first arm and extending outward from the first arm, and a second handle connected to the second arm and extending outward from the second arm. The first handle has a first connector configured for connection to the first arm and a first grip member extending outward from the first connector and configured for gripping by a user. The first connector includes a first shaft extending away from the first grip member and a first projection extending away from the first grip member alongside the first shaft, and the first handle is adjustably connected to the first arm by the first shaft being received in the first mounting hole. The second handle has a second connector configured for connection to the second arm and a second grip member extending outward from the second connector and configured for gripping by the user. The second connector includes a second shaft extending away from the second grip member and a second projection extending away from the second grip member alongside the second shaft, and the second handle is adjustably connected to the second arm by the second shaft being received in the second mounting hole. The first projection is configured to be received in any of the first positioning holes, and the first handle is configured to be rotationally adjustable with respect to the first arm by the first projection being moved between the first positioning holes, such that the first handle is placed in different rotational positions when the first projection is received in each of the first positioning holes. The second projection is configured to be received in any of the second positioning holes, and the second handle is configured to be rotationally adjustable with respect to the second arm by the second projection being moved between the second positioning holes, such that the second handle is placed in different rotational positions when the second projection is received in each of the second positioning holes.

According to one aspect, wherein the mounting portion is configured for removable connection to the supporting structure including a vertical frame member of a weight rack, and the mounting portion includes two side walls and a front wall defining a channel configured to receive the vertical frame member. In this configuration, each of the side walls may have an aperture for receiving a pin that extends through the apertures in the side walls and is further configured for extending through the vertical frame member to connect the mounting portion to the vertical frame member. In this configuration, the channel may extend vertically, and the mounting portion is configured to be connected to the vertical frame member in a use position, where the vertical frame member is configured to be received vertically in the channel, and a storage position, where the weightlifting apparatus is rotated downward relative to the use position.

According to another aspect, the connecting portion includes two laterally spaced legs extending forward from the mounting portion to the first and second arms.

According to a further aspect, the first arm further has a third mounting hole extending inward from the front side of the first arm and spaced from the first mounting hole along a length of the first arm, and a plurality of third positioning holes extending inward from the front side of the first arm and positioned at different locations around the third mounting hole, and the second arm has a fourth mounting hole extending inward from the front side of the second arm and spaced from the second mounting hole along a length of the second arm, and a plurality of fourth positioning holes extending inward from the front side of the second arm and positioned at different locations around the fourth mounting hole. The first handle is also adjustably connectable to the first arm by the first shaft being received in the third mounting hole, and the first projection is configured to be received in any of the third positioning holes. In this position, the first handle is configured to be rotationally adjustable with respect to the first arm by the first projection being moved between the third positioning holes, such that the first handle is placed in different rotational positions when the first projection is received in each of the third positioning holes. The second handle is also adjustably connectable to the second arm by the second shaft being received in the fourth mounting hole, and the second projection is configured to be received in any of the fourth positioning holes. In this position, the second handle is configured to be rotationally adjustable with respect to the second arm by the second projection being moved between the fourth positioning holes, such that the second handle is placed in different rotational positions when the second projection is received in each of the fourth positioning holes. In one configuration, the first mounting hole is positioned adjacent to the third mounting hole, and one of the first positioning holes also serves as one of the third positioning holes.

In this configuration, the first arm may further have a fifth mounting hole extending inward from the front side of the first arm and spaced from the first mounting hole and the third mounting hole along the length of the first arm, and a plurality of fifth positioning holes extending inward from the front side of the first arm and positioned at different locations around the fifth mounting hole, and the second arm may have a sixth mounting hole extending inward from the front side of the second arm and spaced from the second mounting hole and the fourth mounting hole along a length of the second arm, and a plurality of sixth positioning holes extending inward from the front side of the second arm and positioned at different locations around the sixth mounting hole. In this position, the first handle is also adjustably connectable to the first arm by the first shaft being received in the fifth mounting hole, and the first projection is configured to be received in any of the fifth positioning holes, and the first handle is configured to be rotationally adjustable with respect to the first arm by the first projection being moved between the fifth positioning holes, such that the first handle is placed in different rotational positions when the first projection is received in each of the fifth positioning holes. In this position, the second handle is also adjustably connectable to the second arm by the second shaft being received in the sixth mounting hole, and the second projection is configured to be received in any of the sixth positioning holes, and the second handle is configured to be rotationally adjustable with respect to the second arm by the second projection being moved between the sixth positioning holes, such that the second handle is placed in different rotational positions when the second projection is received in each of the sixth positioning holes.

According to yet another aspect, the first shaft extends completely through the first arm, and the second shaft extends completely through the second arm, and the weight-lifting apparatus further includes a first fastener releasably connected to the first shaft on a rear side of the first arm to connect the first handle to the first arm and a second fastener releasably connected to the second shaft on a rear side of the second arm to connect the second handle to the first arm.

According to a still further aspect, the first grip member is angularly offset with respect to the first shaft, such that the first grip member is oriented at different angles with respect to the first arm when the first handle is placed in the different rotational positions, and the second grip member is angularly offset with respect to the second shaft, such that the second grip member is oriented at different angles with respect to the second arm when the second handle is placed in the different rotational positions.

According to an additional aspect, the first connector further includes a first base portion having a first abutment surface configured to confront the front side of the first arm, where the first grip member extends forward from the first base portion, and the first shaft and the first projection extend rearwardly from the first abutment surface. The second connector further includes a second base portion having a second abutment surface configured to confront the front side of the second arm, where the second grip member extends forward from the second base portion, and the second shaft and the second projection extend rearwardly from the second abutment surface.

According to a further aspect, the first and second arms are oriented at an oblique lateral angle to each other when viewed vertically downward.

Additional aspects of the disclosure relate to a weight-lifting apparatus that includes a base having a mounting portion configured for connection to a supporting structure, a first arm and a second arm extending outward on opposite lateral sides of the mounting portion, and a connecting portion connecting the first and second arms to the mounting portion. The first arm has a first mounting hole extending inward from a front side of the first arm, a first positioning hole extending inward from the front side of the first arm, and a second positioning hole extending inward from the front side of the first arm, wherein the first and second positioning holes are positioned at different locations around the first mounting hole. The apparatus also includes a first handle adjustably connectable to the first arm to extend outward from the first arm, the first handle having a first connector configured for connection to the first arm and a first grip member extending outward from the first connector and configured for gripping by a user, where the first connector has a first shaft extending away from the first grip member and a first projection extending away from the first grip member alongside the first shaft. The first handle is adjustably connectable to the first arm by the first shaft being received in the first mounting hole in a first rotational position, where the first projection is received in the first positioning hole, and a second rotational position where the first projection is received in the second positioning hole, and wherein the first grip member is oriented differently in the first and second rotational positions.

According to one aspect, the first arm further has a third positioning hole extending inward from the front side of the first arm, where the first, second, and third positioning holes are positioned at different locations around the first mounting hole. The first handle is further connectable to the first arm in a third rotational position, where the first projection is received in the third positioning hole, and the first grip member is oriented differently in the first, second, and third rotational positions. In this configuration, the first arm may further have a fourth positioning hole extending inward from the front side of the first arm, where the first, second, third, and fourth positioning holes are positioned at different locations around the first mounting hole. The first handle in this configuration is further connectable to the first arm in a fourth rotational position, where the first projection is received in the fourth positioning hole, and the first grip member is oriented differently in the first, second, third, and fourth rotational positions.

According to another aspect, the first grip member is angularly offset with respect to the first shaft, such that the first grip member is oriented at different angles with respect to the first arm in the first rotational position and in the second rotational position.

According to a further aspect, the first arm further has a second mounting hole extending inward from the front side of the first arm and spaced from the first mounting hole along a length of the first arm, a third positioning hole extending inward from the front side of the first arm, and a fourth positioning hole extending inward from the front side of the first arm, wherein the third and fourth positioning holes are positioned at different locations around the second mounting hole. the first handle is further adjustably connectable to the first arm by the first shaft being received in the second mounting hole in a third rotational position, where the first projection is received in the third positioning hole, and a fourth rotational position where the first projection is received in the fourth positioning hole, and the first grip member is oriented differently in the third and fourth rotational positions. In this configuration, the first arm may further include a first mounting plate mounted on the front side of the first arm, and the first mounting hole, the second mounting hole, the first positioning hole, the second positioning hole, the third positioning hole, and the fourth positioning hole all extend through the first mounting plate.

According to yet another aspect, the first shaft extends completely through the first arm, and the weightlifting apparatus further includes a first fastener releasably connected to the first shaft on a rear side of the first arm to connect the first handle to the first arm.

Further aspects of the disclosure relate to a weightlifting apparatus including a base having a mounting portion configured for connection to a supporting structure, a first arm and a second arm extending outward on opposite lateral sides of the mounting portion, and a connecting portion connecting the first and second arms to the mounting portion, where the first arm has a first mounting hole extending inward from a front side of the first arm, and the second arm has a second mounting hole extending inward from a front side of the second arm. The apparatus further includes a first handle connected to the first arm and extending outward from the first arm, and a second handle connected to the second arm and extending outward from the second arm. The first handle has a first connector configured for connection to the first arm and a first grip member extending outward from the first connector and configured for gripping by a user. The first connector includes a first base portion having a first abutment surface configured to confront the front side of the first arm, where the first grip member extends forward from the first base portion, and a first shaft extending rearward from the first base portion. The first handle is adjustably connected to the first arm by the first shaft being received in the first mounting hole. The second handle has a second connector configured for connection to the second arm and a second grip member extending outward from the second connector and configured for gripping by the user. The second connector a second base portion having a second abutment surface configured to confront the front side of the second arm, where the second grip member extends forward from the second base portion, and a second shaft extending away from the second base portion. The second handle is adjustably connected to the second arm by the second shaft being received in the second mounting hole. The apparatus also includes a plurality of first positioning holes extending inward from one of the front side of the first arm and the first abutment surface of the first connector, and a first projection extending outward from the other of the front side of the first arm and the first abutment surface of the first connector. The first projection is configured to be received in any of the first positioning holes, and the first handle is configured to be rotationally adjustable with respect to the first arm by the first projection being moved between the first positioning holes, such that the first handle is placed in different rotational positions when the first projection is received in each of the first positioning holes. The apparatus further includes a plurality of second positioning holes extending inward from one of the front side of the second arm and the second abutment surface of the second connector, and a second projection extending outward from the other of the front side of the second arm and the second abutment surface of the second connector. The second projection is configured to be received in any of the second positioning holes, and the second handle is configured to be rotationally adjustable with respect to the second arm by the second projection being moved between the second positioning holes, such that the second handle is placed in different rotational positions when the second projection is received in each of the second positioning holes.

According to one aspect, the first positioning holes extend inward from the first abutment surface of the first connector, and the first projection extends outward from the front side of the first arm, and the second positioning holes extend inward from the second abutment surface of the second connector, and the second projection extends outward from the front side of the second arm. The first arm further includes a first mounting plate mounted on the front side of the first arm, and the first projection is connected to the first mounting plate and extends outward from the first mounting plate. The second arm further includes a second mounting plate mounted on the front side of the second arm, and the second projection is connected to the second mounting plate and extends outward from the second mounting plate.

Still further aspects of the disclosure relate to a weightlifting apparatus including a base having a mounting portion configured for connection to a supporting structure, a right arm and a left arm extending outward on opposite lateral sides of the mounting portion, and a connecting portion connecting the right and left arms to the mounting portion. The right arm has a first right mounting hole extending inward from a front side of the right arm and a plurality of first right positioning holes extending inward from the front side of the right arm and positioned at different locations around the first right mounting hole, and a second right mounting hole extending inward from the front side of the right arm and a plurality of second right positioning holes extending inward from the front side of the right arm and positioned at different locations around the second right mounting hole. The left arm has a first left mounting hole extending inward from a front side of the left arm and a plurality of first left positioning holes extending inward from the front side of the left arm and positioned at different locations around the first left mounting hole, and a second left mounting hole extending inward from the front side of the left arm and a plurality of second left positioning holes extending inward from the front side of the left arm and positioned at different locations around the second left mounting hole. A first handle is adjustably connectable to the right arm to extend outward from the right arm, the first handle having a first connector configured for connection to the right arm and a first grip member extending outward from the first connector and configured for gripping by a user. The first connector includes a first shaft extending away from the first grip member and a first projection extending away from the first grip member alongside the first shaft. In this configuration, the first handle is adjustably connectable to the right arm in a first position by the first shaft being received in the first right mounting hole and in a second position by the first shaft being received in the second right mounting hole. The first projection is configured to be received in any of the first right positioning holes, and when the first handle is connected to the right arm in the first position, the first handle is configured to be rotationally adjustable with respect to the right arm by the first projection being moved between the first right positioning holes, such that the first handle is placed in different rotational positions when the first projection is received in each of the first right positioning holes. The first projection is also configured to be received in any of the second right positioning holes, and when the first handle is connected to the right arm in the second position, the first handle is configured to be rotationally adjustable with respect to the right arm by the first projection being moved between the second right positioning holes, such that the first handle is placed in different rotational positions when the first projection is received in each of the second right positioning holes. A second handle is adjustably connectable to the left arm to extend outward from the left arm, the second handle having a second connector configured for connection to the left arm and a second grip member extending outward from the second connector and configured for gripping by the user. The second connector includes a second shaft extending away from the second grip member and a second projection extending away from the second grip member alongside the second shaft. In this configuration, the second handle is adjustably connectable to the left arm in a third position by the second shaft being received in the first left mounting hole and in a fourth position by the second shaft being received in the second left mounting hole. The second projection is configured to be received in any of the first left positioning holes, and when the second handle is connected to the left arm in the third position, the second handle is configured to be rotationally adjustable with respect to the left arm by the second projection being moved between the first left positioning holes, such that the second handle is placed in different rotational positions when the second projection is received in each of the first left positioning holes. The second projection is also configured to be received in any of the second right positioning holes, and when the second handle is connected to the left arm in the fourth position, the second handle is configured to be rotationally adjustable with respect to the left arm by the second projection being moved between the second left positioning holes, such that the second handle is placed in different rotational positions when the second projection is received in each of the second left positioning holes.

According to one aspect, wherein the mounting portion is configured for removable connection to the supporting structure including a vertical frame member of a weight rack, and the mounting portion includes two side walls and a front wall defining a channel configured to receive the vertical frame member. Each of the side walls has an aperture for receiving a pin that extends through the apertures in the side walls and is further configured for extending through the vertical frame member to connect the mounting portion to the vertical frame member.

According to another aspect, the connecting portion includes two laterally spaced legs extending forward from the mounting portion to the right and left arms.

According to a further aspect, the first right mounting hole is positioned adjacent to the second right mounting hole, and one of the first right positioning holes also serves as one of the second right positioning holes, and wherein the first left mounting hole is positioned adjacent to the second left mounting hole, and one of the first left positioning holes also serves as one of the second left positioning holes.

According to yet another aspect, the first shaft extends completely through the right arm, and the second shaft extends completely through the left arm, and the weightlifting apparatus further includes a first fastener releasably connected to the first shaft on a rear side of the right arm to connect the first handle to the right arm, and a second fastener releasably connected to the second shaft on a rear side of the left arm to connect the second handle to the left arm.

According to a still further aspect, the first grip member is angularly offset with respect to the first shaft, such that the first grip member is oriented at different angles with respect to the right arm when the first handle is placed in the different rotational positions, and the second grip member is angularly offset with respect to the second shaft, such that the second grip member is oriented at different angles with respect to the left arm when the second handle is placed in the different rotational positions.

Other aspects of the disclosure relate to a method of using and/or assembling a weightlifting apparatus according to any of the aspects discussed herein. The method includes connecting a handle to an arm of the weightlifting apparatus in a desired lateral and rotational position by inserting a shaft of the handle into a desired mounting hole on the arm in a desired lateral position, such that a projection as discussed herein is received in a positioning hole to set the handle in the desired rotational position. The method may further include adjusting the lateral and/or rotational position of the handle by completely or partially disconnecting the handle from the arm and repositioning the handle such that the shaft is received in a different mounting hole and/or the projection is received in a different positioning hole.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
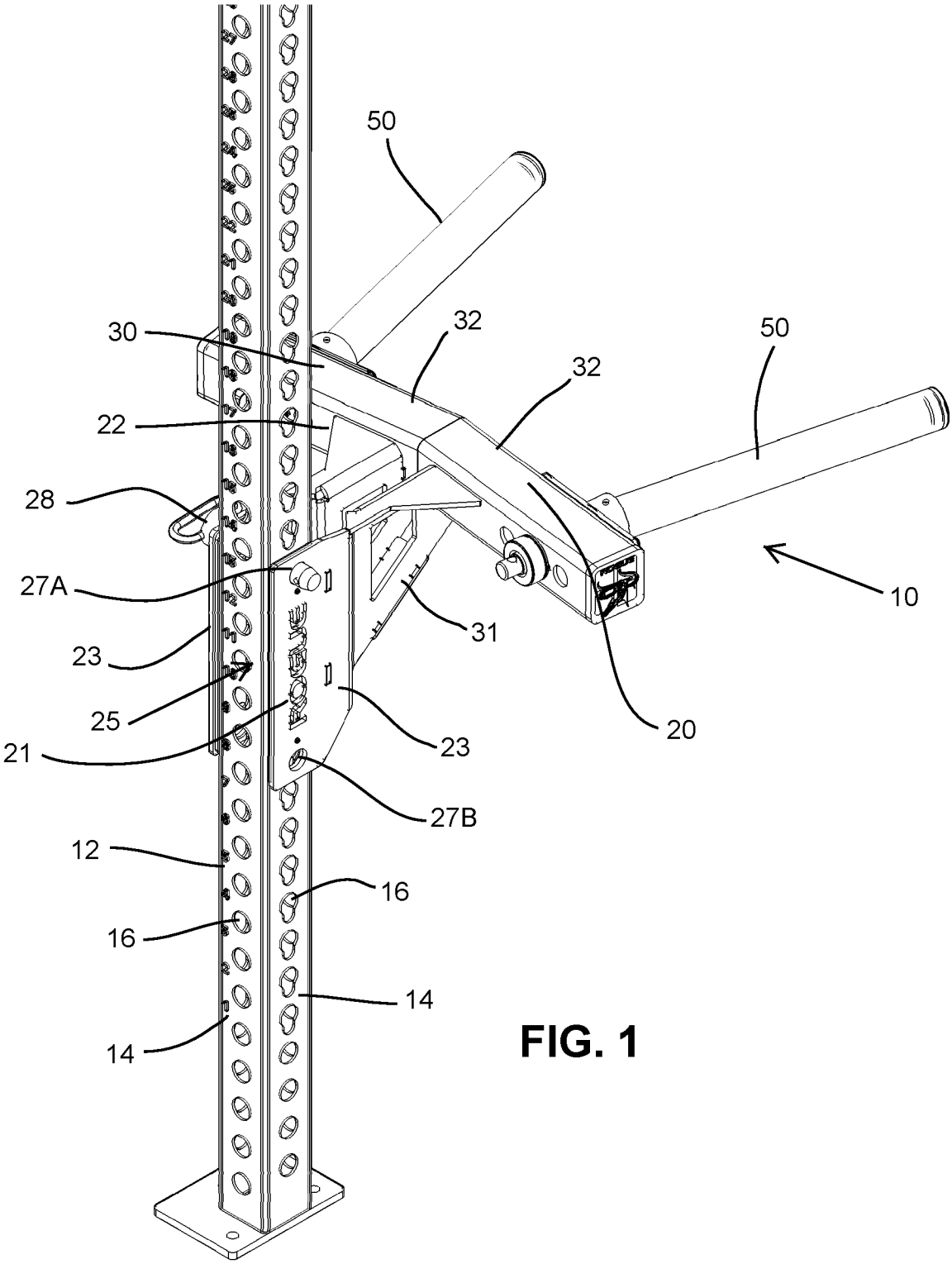
FIG. 1 is a rear perspective view of one embodiment of a weightlifting apparatus in the form of a dip apparatus according to aspects of the present disclosure, connected to a weight rack in a use position.
Figure 2:
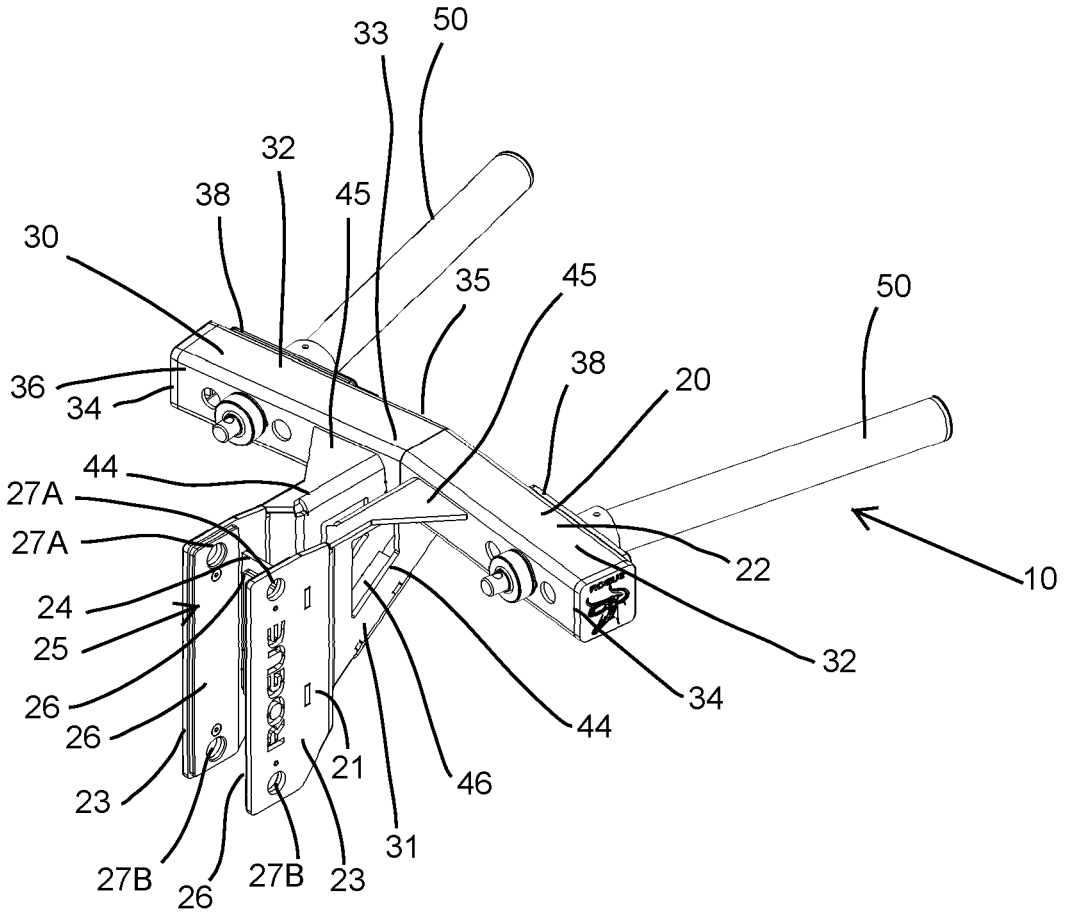
FIG. 2 is a rear perspective view of the weightlifting apparatus of FIG. 1.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Figure 13:
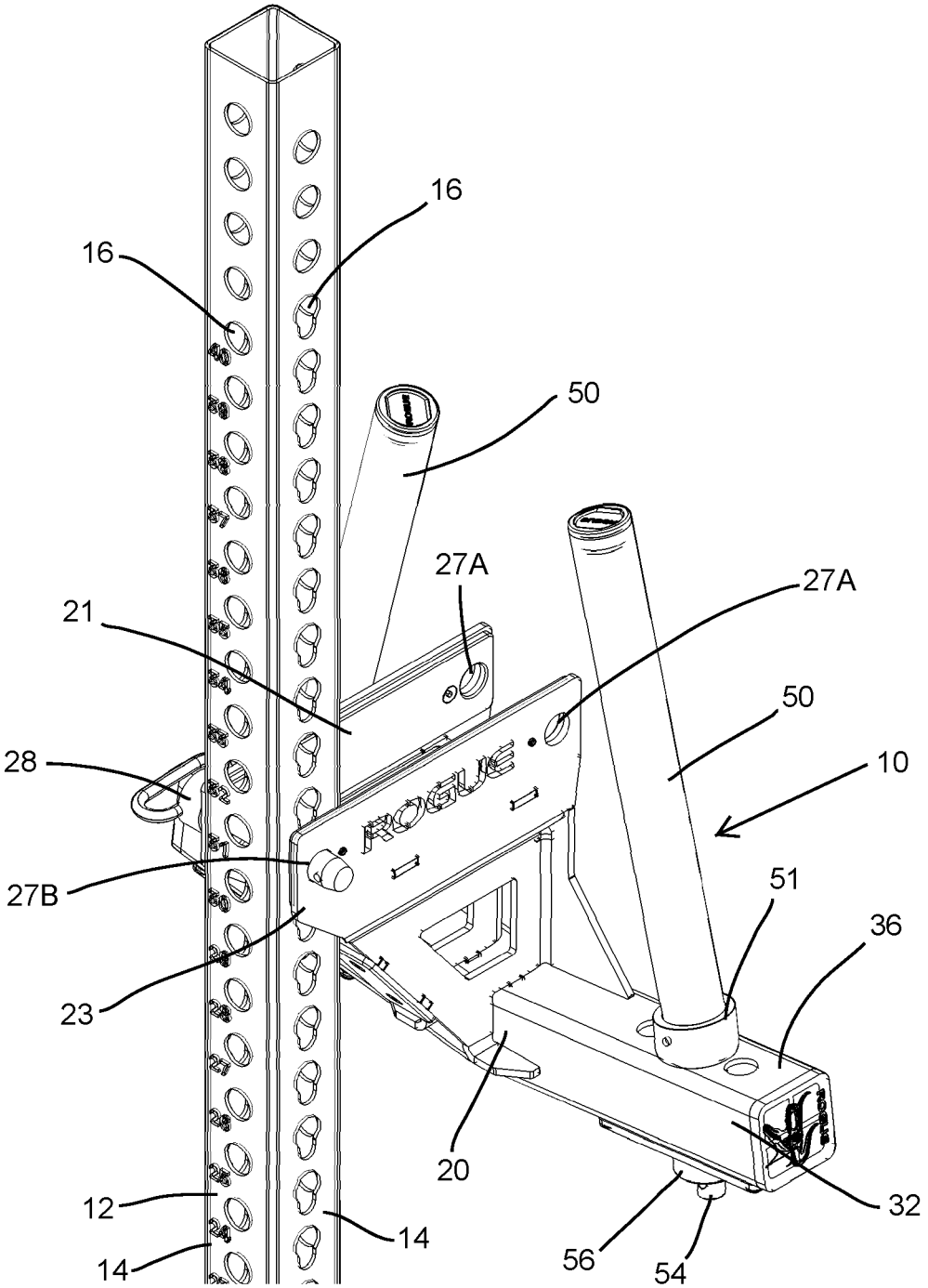
FIG. 13 is a rear perspective view of the weightlifting apparatus of FIG. 1, connected to the weight rack in a storage position.
Figure 14:
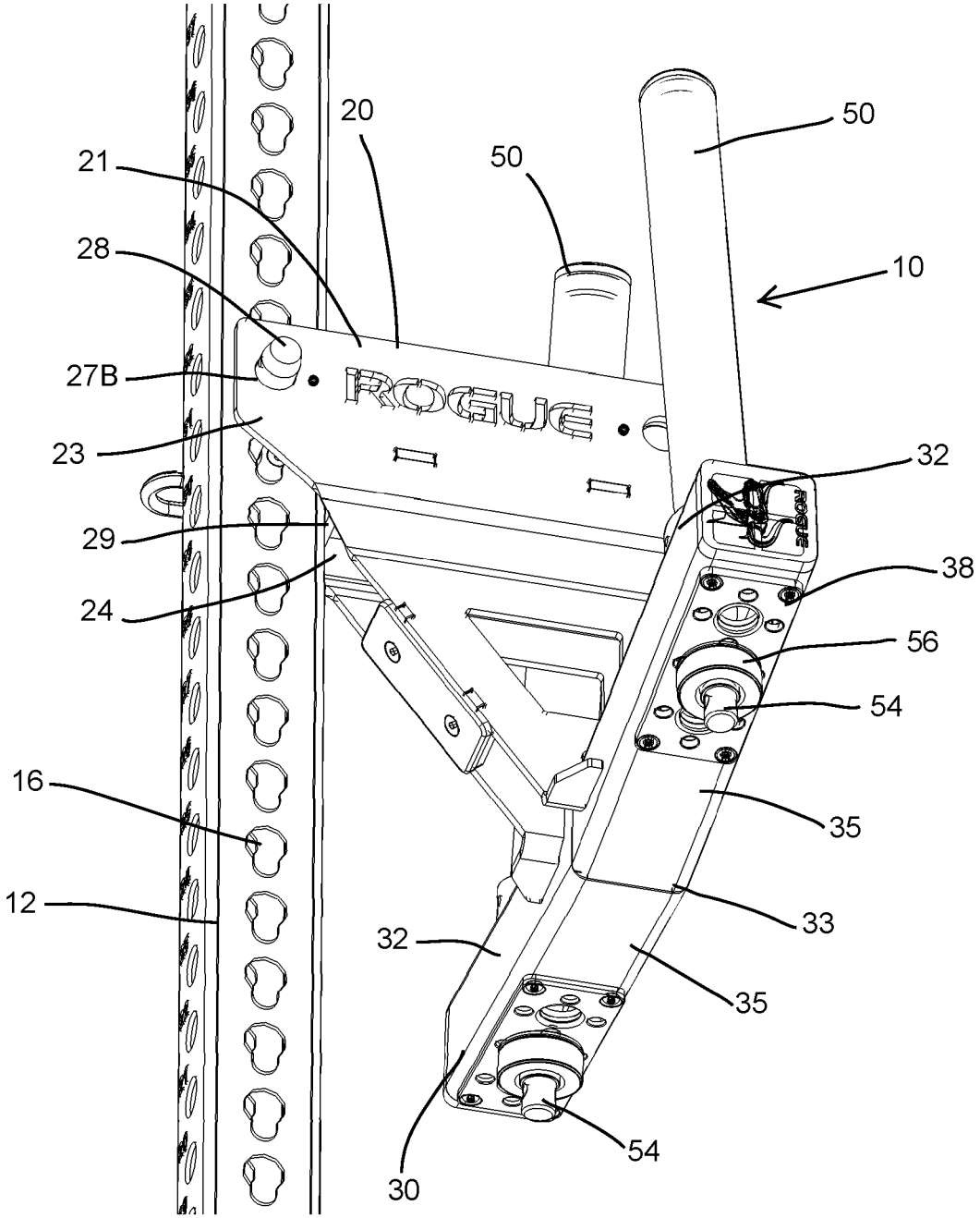
FIG. 14 is a bottom rear perspective view of the weightlifting apparatus of FIG. 13.

Referring to FIG. 1, a weightlifting apparatus 10 is shown connected to a supporting structure in the form of a vertically extending frame member 12 of a weightlifting rack assembly or another post member. The weightlifting apparatus 10 is configured to be removably attached to the frame member 12 as described in greater detail herein. The frame member 12 as shown in FIG. 1 may be a hollow bar formed of a plurality of sidewalls 14, surrounding and defining an interior cavity. In certain embodiments, the frame member 12 may have a square or other rectangular cross-section. The frame member 12 may include a plurality of frame member apertures 16 formed in one or more of the sidewalls 14. In certain embodiments, at least some of the frame member apertures 16 may be round, and at least some of the frame member apertures 16 may be keyhole-shaped. The weightlifting apparatus 10 in FIG. 1 is shown connected to the frame member 12 in a use position, configured for use in a weightlifting exercise. FIGS. 13-14 illustrate the weightlifting apparatus 10 connected to the frame member 12 in a storage position, as described in greater detail herein.

The weightlifting apparatus 10 in FIG. 1 is illustrated in greater detail in FIGS. 2-12, and in this embodiment, is in the form of a dip apparatus configured for use in a dip exercise and configured for use as an attachment to a weight rack or similar structure. The apparatus 10 has a base 20 configured for connection to the frame member 12 and two handles 50 removably and/or adjustably connected to the base 20. The base 20 of the apparatus 10 has a mounting portion 21 having structures for connecting the apparatus 10 to the frame member 12 and a supporting portion 22 having structures for removable connection to the handles 50. The mounting portion 21 includes two side walls 23 and a front wall 24 defining a C-shaped channel 25 configured to receive the frame member 12. The side walls 23 and the front wall 24 all may have protective plates 26, e.g., made from a high strength polymeric material (including fiber-reinforced polymers), surrounding the channel 25 to resist damage to the frame member 12 and the apparatus 10 and/or decrease friction. The side walls 23 and the plates 26 have apertures 27A-B for receiving connectors, e.g., a removable pin 28 that extends through the side walls 23, the plates 26, and the frame member apertures 16, as shown in FIG. 1. When the apparatus 10 is in the use position, as shown in FIG. 1, a pin 28 is received through at least the upper apertures 27A. When the apparatus is instead placed in a storage position, as shown in FIGS. 13 and 14, the lower apertures 27B may be used. The side walls 23 extend below the bottom end 29 of the front wall 24 in this embodiment, such that the lower apertures 27B are below the bottom end 29. In this configuration, a pin 28 received through the lower apertures 27B, and the bottom end 29 of the front wall 24 abuts the adjacent sidewall 14 of the frame member 12 to prevent further downward rotation of the apparatus 10. In one embodiment, pins 28 may be received through both apertures 27A-B in the use position, and movement to the storage position may be accomplished by removing the pin 28 in the upper apertures 27A and rotating the apparatus 10 downward to the use position. After rotation downward to the storage position, the channel 25 extends horizontally, the frame member 12 extends between the end portions of the side walls 23 in a direction transverse or perpendicular (relative to the apparatus 10) to the direction through which the frame member 12 extends in the use position. The plates 26 on the side walls 23 may also extend below the bottom end 29 of the front wall 24 in this embodiment.

In another embodiment, the mounting portion 21 may use a different structure for mounting to a vertical weight rack frame member 12, such as a J-cup structure, a flat abutting structure, etc. It is understood that different types of fasteners or other removable connecting structures may be used in connection with the mounting portion 21 in other embodiments, and that the mounting portion 21 may be structured to accommodate such structures. It is also understood that such different structures for the mounting portion 21 may require a different configuration for the storage position, or may not enable the use of a storage position for the apparatus 10. In a further embodiment, the apparatus 10 may be configured for connection to a different type of supporting structure, such as a specially designed support. For example, the apparatus 10 may be configured as a free-standing apparatus with a base structure configured for resting on a floor.

Figure 5:
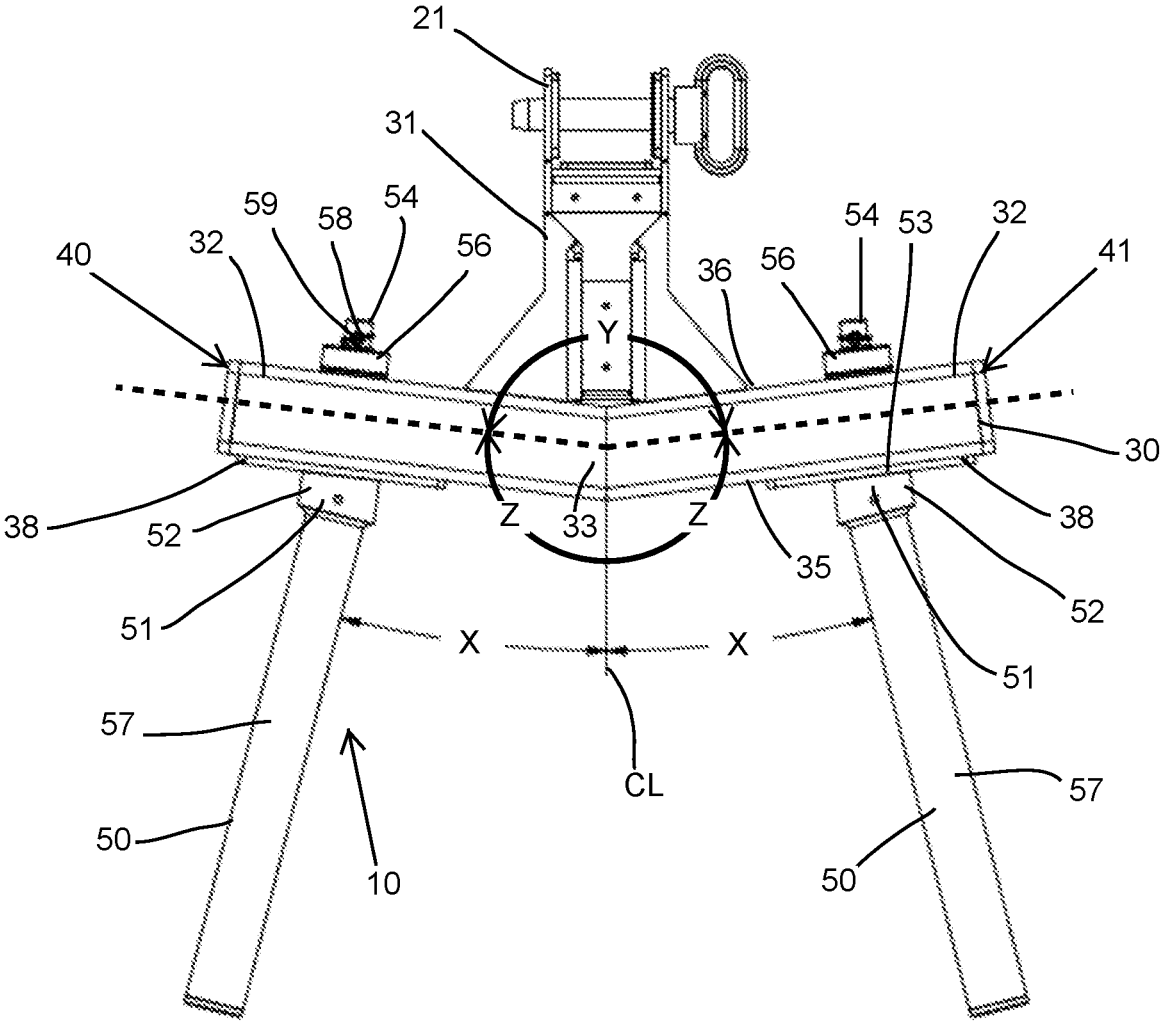
FIG. 5 is a top view of the weightlifting apparatus of FIG. 1.

The supporting portion 22 of the apparatus 10 in FIGS. 1-12 has an arm structure 30 configured for removable mounting of the handles 50 and a connecting portion 31 fixedly connecting the arm structure 30 to the mounting portion 21. In one embodiment, the arm structure 30 has a first side 40 and a second side 41 on opposite lateral sides of a lateral centerline CL passing through a center area 33, with each of the first side 40 and the second side 41 configured for mounting one of the handles 50. The arm structure 30 in this embodiment includes two arms 32 (which may be referred to as left and right arms 32, or more generally as first and second arms 32) extending in substantially opposite directions from the center area 33 to a distal end 34, such that the arms 32 are positioned on opposite sides 40, 41 of the arm structure 30. The arms 32 may be oriented at an oblique angle Y to each other and an oblique angle Z to the lateral centerline CL of the apparatus 10, when viewed vertically downward from above. The angles X,Y of the arms 32 are lateral or horizontal angles in the embodiment of FIGS. 1-12, but the arms 32 may have vertical angular components with respect to each other in other embodiments. FIG. 5 illustrates these angles X,Y, and in the embodiment of FIGS. 1-12, the angle Y is 166°, and the angle Z is 97°. These angles may be different in other embodiments, depending on the desired range of angles for the handles 50 that are connected to the arms 32. The arms 32 are formed of substantially square tubular metallic (e.g., steel) beams and have a front surface 35 and a rear surface 36.

The connecting portion 31 in FIGS. 1-12 extends forward and upward from the mounting portion 21 to the arm structure 30, and includes two laterally spaced legs 44 extending from the mounting portion 21 to the arms 32 of the arm structure 30. The legs 44 connect to the arm structure 30 at or around the center area 33 of the arm structure 30. Each leg 44 is a generally vertical plate member that angles upward and forward to the mounting portion 21. Each leg 44 also has a wing 45 that extends laterally outward at the top of the leg 44 and laterally along the rear surface 36 of the respective arm 32 and a fin 47 that extends laterally outward along the bottom of the respective arm 32. In one embodiment, each leg 44 and connected wing 45 and fin 47 are formed together of a single plate member. In another embodiment, each combination of a leg 44, a wing 45, and a fin 47 is formed as a single plate along with one of the side walls 23 of the mounting portion 21. In another embodiment, the connecting portion 31 may be welded to the mounting portion 21. The connecting portion 31 may further include a transverse plate 46 on the underside of the connecting portion, such that the transverse plate 46 is connected to the legs 44 and extends between the legs 44. The transverse plate 46 may provide strength and rigidity to the legs 44 and may also form a protective plate on the underside of the connecting portion 31.

Figure 6:
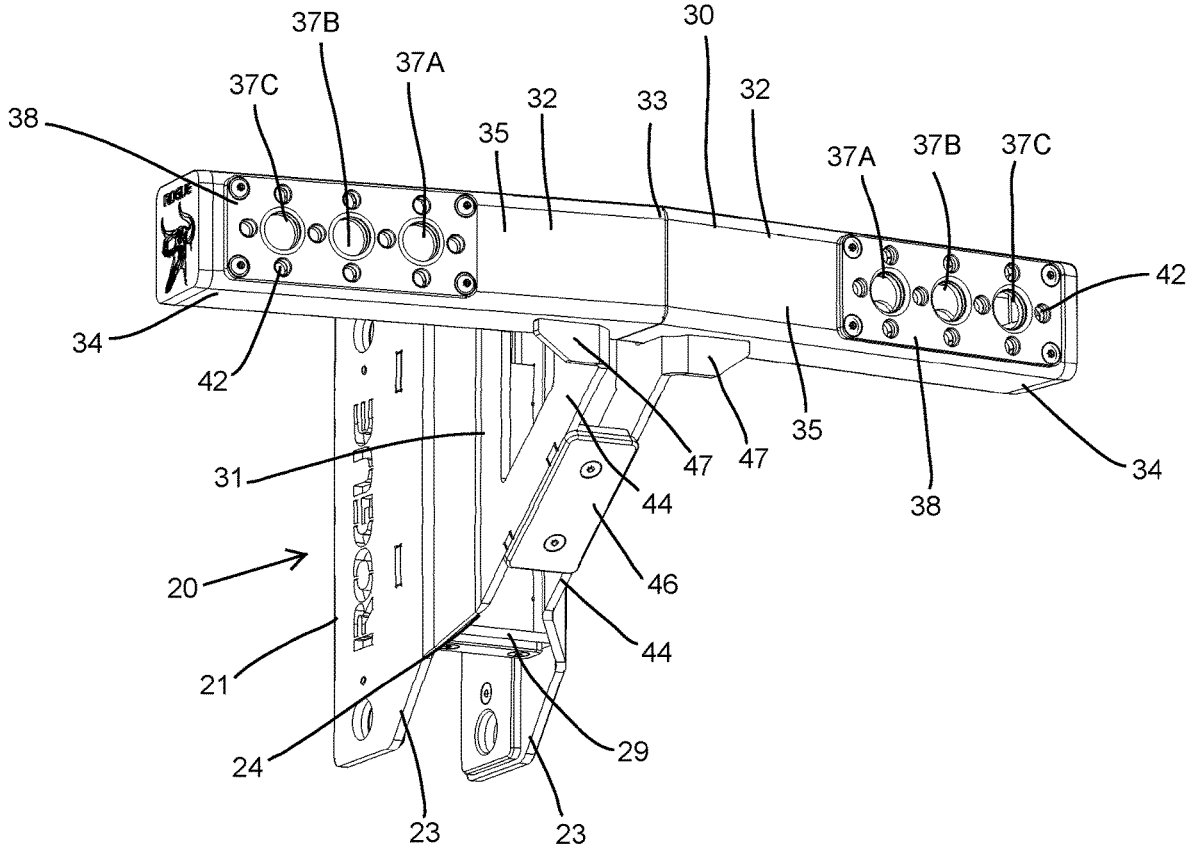
FIG. 6 is a bottom front perspective view of the base of the weightlifting apparatus of FIG. 1.

The arm structure 30 has mounting holes 37 extending inward from the front side of the arm structure 30 and configured for receiving a portion of each handle 50 for mounting the handles 50 on the arm structure 30. In the embodiment of FIGS. 1-12, the mounting holes 37 extend through both the front surface 35 and the rear surface 36 of each arm 32, and each side 40, 41 of the arm structure 30 has three vertically-aligned mounting holes 37 positioned side-by-side at equal spacings from each other. In the configuration shown in FIGS. 1-12, the arm structure 32 has a first pair of mounting holes 37A spaced from each other by a first distance, a second pair of mounting holes 37B spaced from each other by a second distance greater than the first distance, and a third pair of mounting holes 37C spaced from each other by a third distance greater than the first and second distances, as shown in FIG. 6. For example, the spacing between the mounting holes 37 may be about 3.7 inches, and the first, second, and third distances may be 13.4 inches, 17.1 inches, and 20.8 inches, respectively.

Additionally, the arm structure 30 includes mounting plates 38 connected to the front surfaces 35 of each of the arms 32, such that the front sides of the arm structure 30 are formed at least partially by both the front surfaces 35 of the arms 32 and the mounting plates 38. The mounting plates 38 may be formed of a different material from the arms 32, such as a polymeric material (including fiber-reinforced polymers), to resist damage to the handles 50 and/or the arms 32. It is understood that the mounting plates 38 provide advantages such as improved durability and impact reduction, but are not necessary to achieve the adjustability function of the arm structure 30 and handles 50. The mounting plates 38 are fixed to the front surfaces 35 of the arms 32, e.g., by fasteners, welding, or other connecting structures. The mounting holes 37 also pass through the mounting plates 38 in this embodiment, such that each mounting hole 37 is a continuous passage through the arm structure 30 formed by aligned holes in the mounting plate 38, the front surface 35 of the arm 32, and the rear surface 36 of the arm 32. In another embodiment, the mounting holes 37 may not extend completely through the arm structure 30, and may extend inward from the front side of the arm structure 30 through a portion of the arm structure 30.

Figure 3:
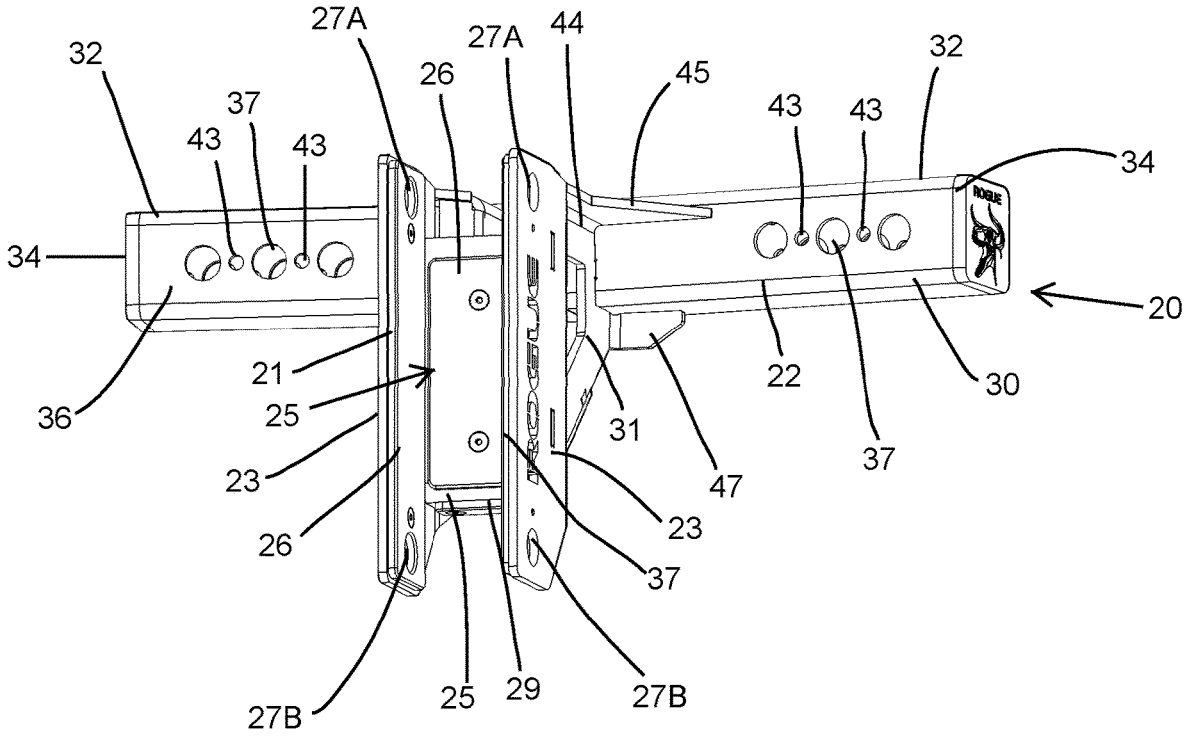
FIG. 3 is a bottom rear perspective view of a base of the weightlifting apparatus of FIG. 1.
Figure 4:
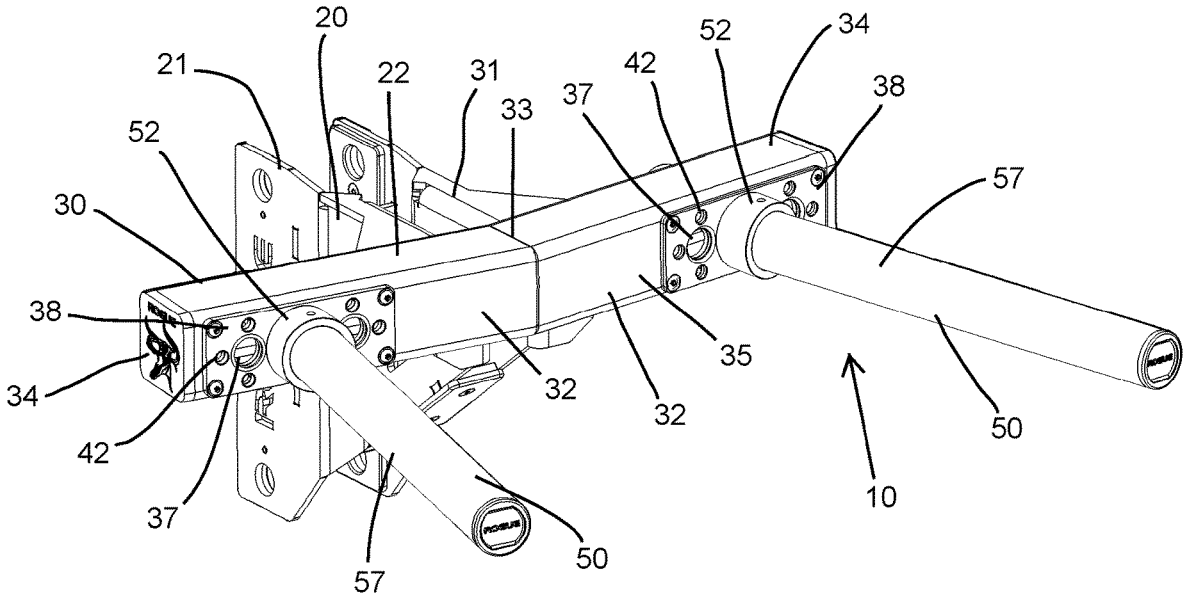
FIG. 4 is a front perspective view of the weightlifting apparatus of FIG. 1.

The arm structure 30 also has a plurality of positioning holes 42 positioned around the mounting holes 37 on the front side to permit adjustment of the orientation of the handles 50 received in the respective mounting holes 37. Each of the positioning holes 42 extends through the mounting plates 38 and the front surface 35 of the arm 32, but may not extend through the rear surface 36 of the arm 32. As seen in FIG. 3, the rear surface 36 of each arm 32 has two secondary positioning holes 43 extending inward, which may be aligned with some of the positioning holes 42 on the front side of the arm structure 30.

The positioning holes 42 are arranged to surround each of the mounting holes 37 to provide a plurality of different rotational positions for the handles 50 as described herein. In one embodiment, each mounting hole 37 has the same number of positioning holes 42 surrounding the respective mounting hole 37 at regular intervals. Each mounting hole 37 in FIGS. 1-12 has four positioning holes 42 surrounding the respective mounting hole 37, located on both vertical sides and both horizontal sides of the mounting hole 37, i.e., at 90° intervals around the mounting hole 37. Additionally, adjacent mounting holes 37 may share a positioning hole 42, as shown in FIG. 6, where the second mounting holes 37B share a positioning hole 42 with each of the first and third mounting holes 37A, 37C. It is understood that in other embodiments, the configurations of the mounting holes 37 and the positioning holes 42, 43 may be different, such as by having a different number of mounting holes 37 and/or positioning holes 42, 43. For example, in one embodiment, each arm 32 may have only a single mounting hole 37 with a plurality of adjacent positioning holes 42. In another embodiment, the arm structure 30 may not include any secondary positioning holes 43. In a further embodiment, the various mounting holes 37 may have different numbers of adjacent positioning holes 42.

The handles 50 are configured for connection to the arm structure 30 such that the handles 50 extend outwardly from the arms 32. An example of one of the handles 50 of FIGS. 1-12 is shown in more detail in FIG. 8. Each handle 50 has a connector 51 configured for connection to the arm structure 30 and a grip member 57 extending outward from the connector 51. The grip member 57 of FIGS. 1-12 is a single cylindrical member, but may have a different and/or more complex structure in another embodiment. The connector 51 includes a base portion 52 having an abutment surface 53 configured to abut the arm structure 30 (i.e., the mounting plate 38) and to confront the front side of the arm 32, a shaft 54 extending rearwardly from the base portion 52 and away from the grip member 57, and a projection 55 extending rearwardly from the abutment surface 53 of the base portion 52 and away from the grip member 57 alongside the shaft 54. The projection 55 in FIGS. 1-12 is significantly smaller than the shaft 54, both in length and diameter and extends parallel to the shaft 54. The connector 51 is configured for removable connection to one of the arms 32 of the arm structure 30 by having the shaft 54 received in one of the mounting holes 37. While the connector 51 is illustrates as including a base portion 52 as a separate piece from the grip member 57 in the embodiment of FIGS. 1-12, it is understood that in another embodiment, the connector 51 may include only the shaft 54 and a projection 55 or positioning holes 42 connected to the grip member 57. A fastening structure may be used to secure the connection between the shaft 54 and the arm 32, such as by using a threaded knob 56 or other fastener to engage threading on the shaft 54 as in FIGS. 1-12 and/or a different type of connector and/or fastener, such as a removable or releasable pin. The shaft 54 additionally has an aperture 58 near the distal end thereof, which can be used to receive a releasable pin 59 to further secure the connection, as shown in FIG. 5. The spacing between the mounting holes 37 in which the shafts 54 of the two handles 50 are inserted controls the spacing between the base portions 52 of the handles 50, and this spacing can be adjusted by shifting the handles 50 to different mounting holes 37.

The projection 55 is capable of being received in any of the positioning holes 42 adjacent to the mounting hole 37 in the configuration of FIGS. 1-12. When the shaft 54 is inserted into one of the mounting holes 37, the projection 55 is received in one of the positioning holes 42 adjacent to the mounting hole 37. By rotating the handle 50 to insert the projection 55 into different positioning holes 42, the rotational position of the handle 50 can be adjusted. Shifting from one rotational position to another can be accomplished by releasing the connection of the shaft 54 to the arm structure 30, rotating the handle 50, and re-inserting the shaft 54 into the mounting hole 37 with the projection 55 received in a different positioning hole 42.

Figure 15:
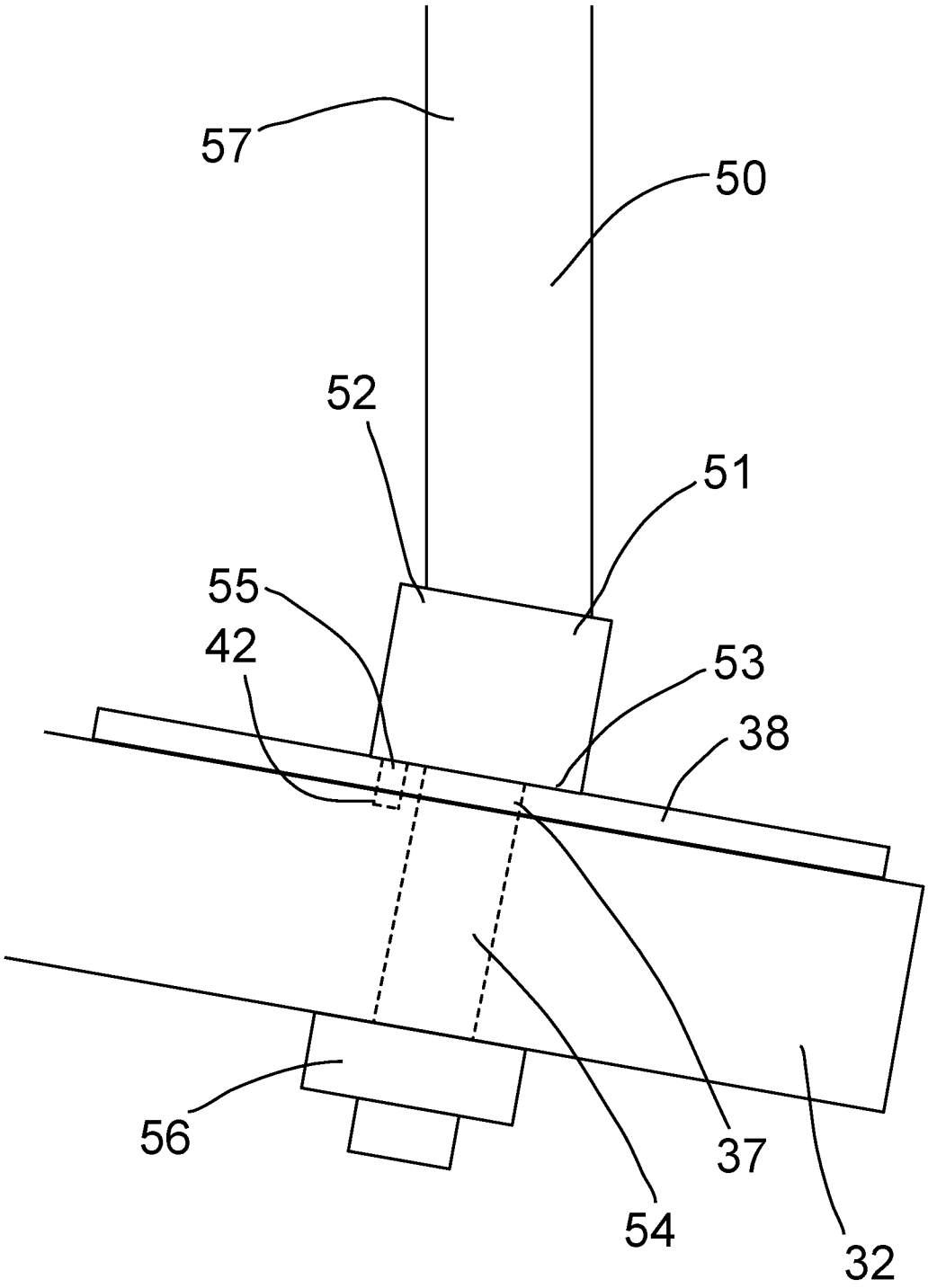
FIG. 15 is a top view of a portion of one embodiment of a connection of a handle to an arm structure of a weightlifting apparatus according to aspects of the disclosure.
Figure 16:
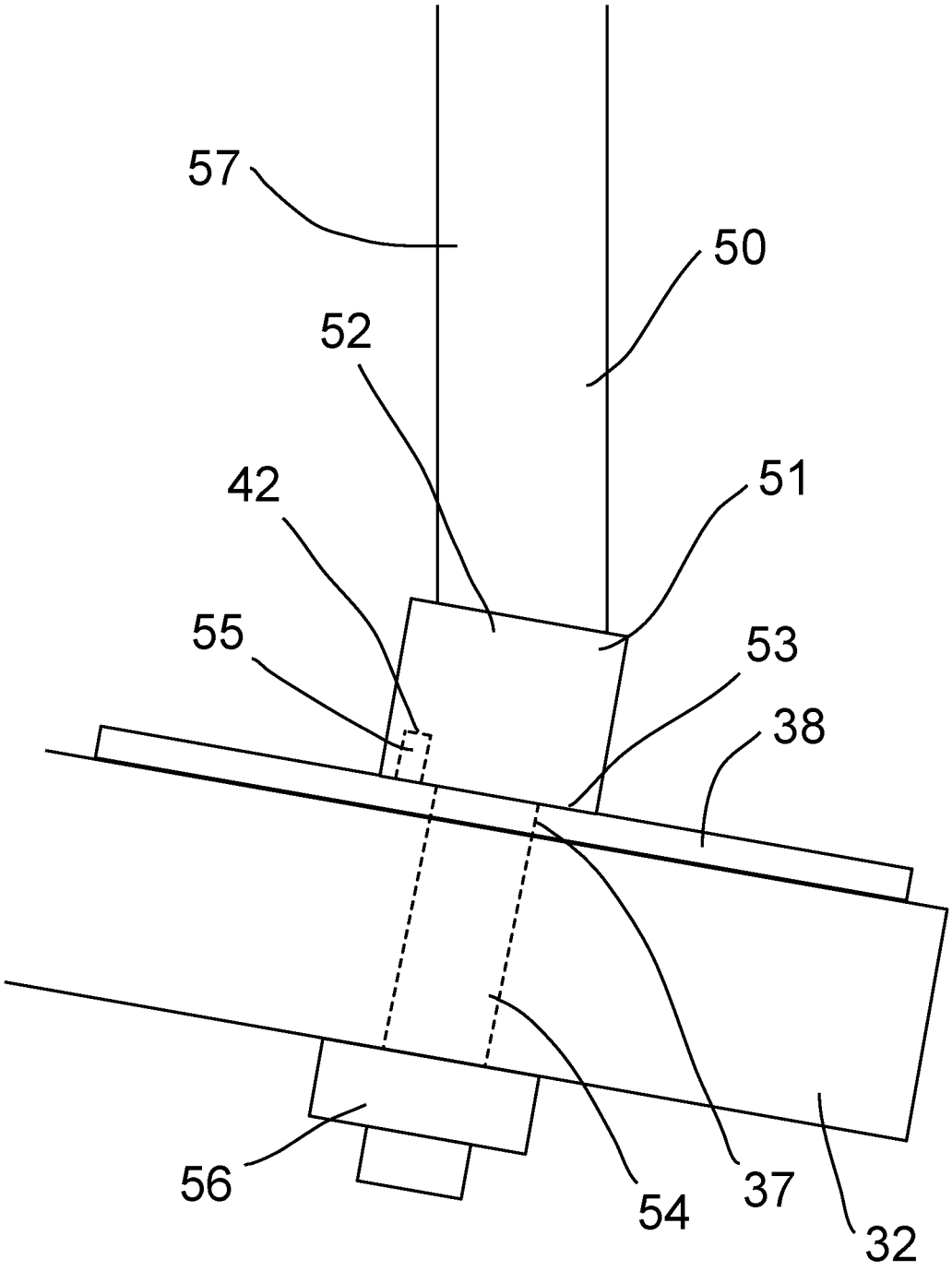
FIG. 16 is a top view of a portion of another embodiment of a connection of a handle to an arm structure of a weightlifting apparatus according to aspects of the disclosure.

FIG. 15 illustrates the shaft 54 of a handle 50 inserted through one of the mounting holes 37 in the respective arm 32, with the projection 55 received in one of the positioning holes 42 in the arm 32 adjacent to the mounting hole, as in the embodiment of FIGS. 1-12 discussed herein. In another embodiment, the locations of the projection 55 and the positioning holes 42 may be transposed, such that the projection 55 extends outward from the front side of the arm 32 (e.g., from the mounting plate 38 or through the mounting plate 38), and the abutment surface 53 of the base 52 of the connector 51 on the respective handle 50 has a plurality of positioning holes 42 arranged around the shaft 54 for receiving the projection 55. FIG. 16 illustrates an example of such an embodiment, where a projection 55 extends outward from the mounting plate 38 and is received in a positioning hole 42 in the handle 50. Accordingly, in one embodiment, the apparatus 10 has a plurality of positioning holes 42 extending inward from one of the front side of the arm 32 and the abutment surface 53 of the connector 51 of the handle 50, and a projection 55 extending outward from the other of the front side of the arm 32 and the abutment surface 53 of the connector 51 of the handle 50. In this configuration, the projection 55 is configured to be received in any of the positioning holes 42 to place the handle in different rotational positions as discussed herein.

Figure 7:
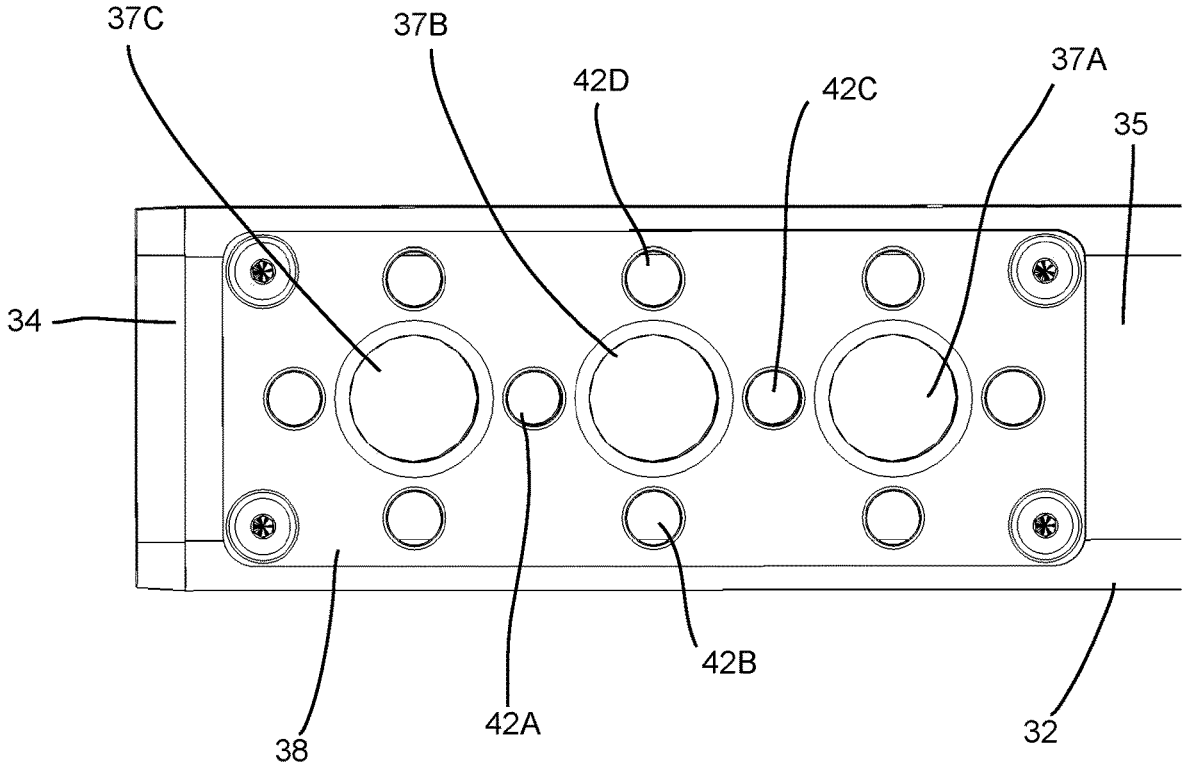
FIG. 7 is a magnified plan view of a portion of the base of the weightlifting apparatus of FIG. 1.
Figure 8:
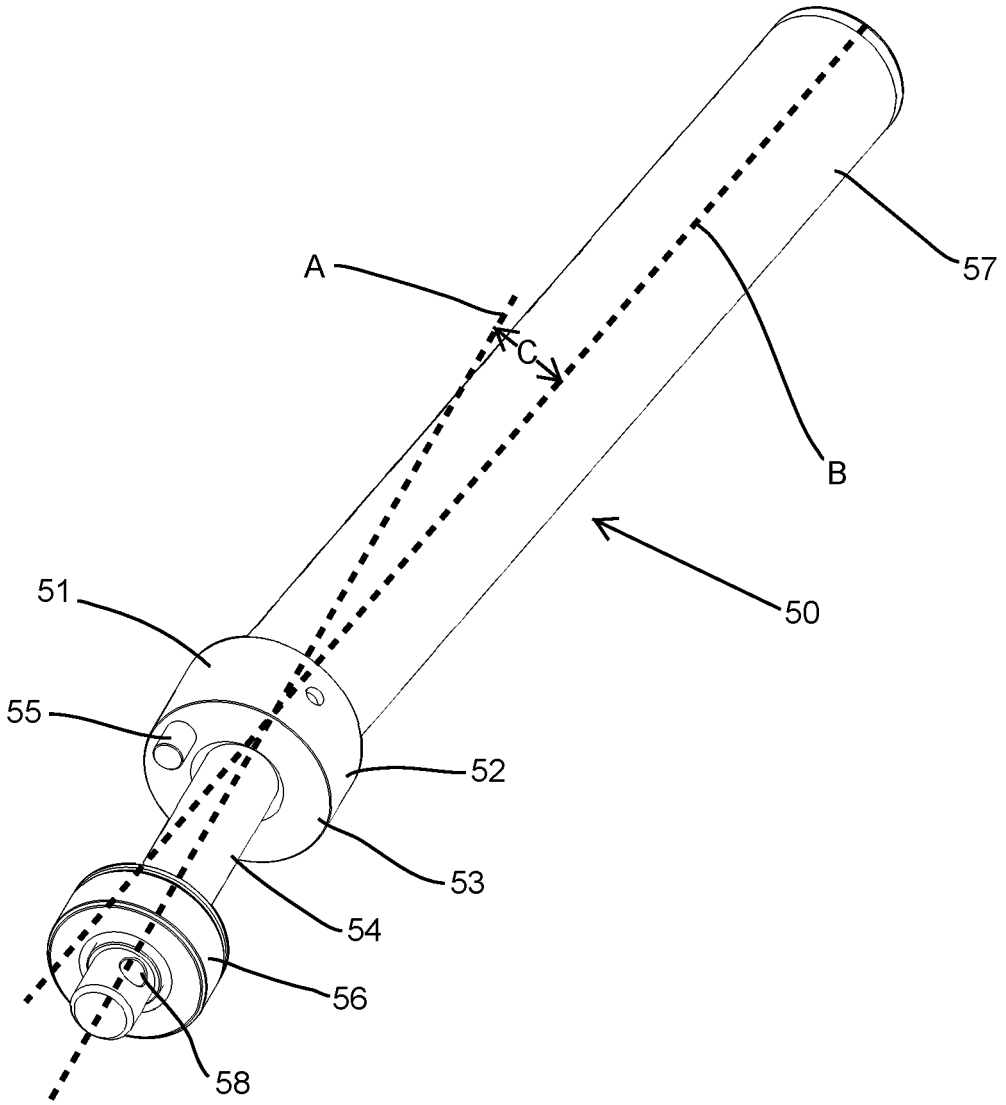
FIG. 8 is a rear perspective view of a bar of the weightlifting apparatus of FIG. 1.

In the embodiment of FIGS. 1-12, the grip member 57 is angularly offset with respect to the connector 51 and the shaft 54 thereof, such that rotation of the base 52 orients the grip member 57 at different angles with respect to the base 20 of the apparatus 10, at different angles with respect to the arm 32, and at different angles X with respect to the lateral centerline CL. As shown in FIG. 8, the shaft 54 defines a first axis A, and the grip member 57 defines a second axis B that is angled at an angle C with respect to the first axis A within a plane defined by both axes A,B. In one embodiment, the angle C is from 5° to 10°, e.g., an angle C of 7°. It is understood that the grip member 57 may be more complex than a simple linear member in some embodiments, and definition of the second axis B may be more complicated. As a result of this angular offset, rotation of the handle 50 between the different rotational mounting positions creates different handle 50 orientations.

Figure 9:
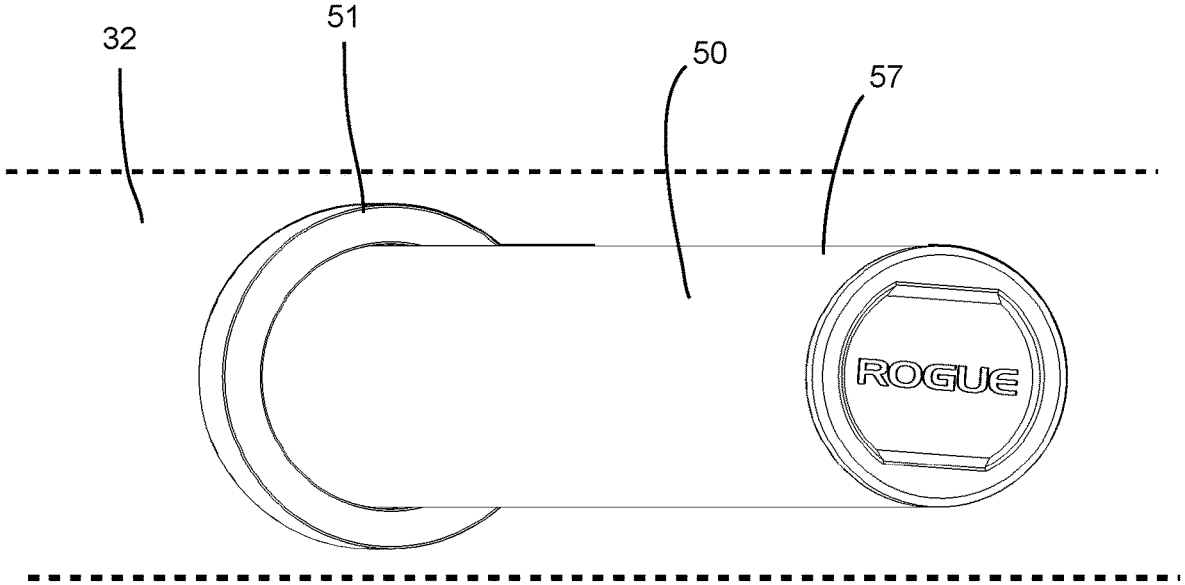
FIG. 9 is a front view of the bar of FIG. 7, shown in a first rotational position, with a portion of the base shown schematically in broken lines.
Figure 10:
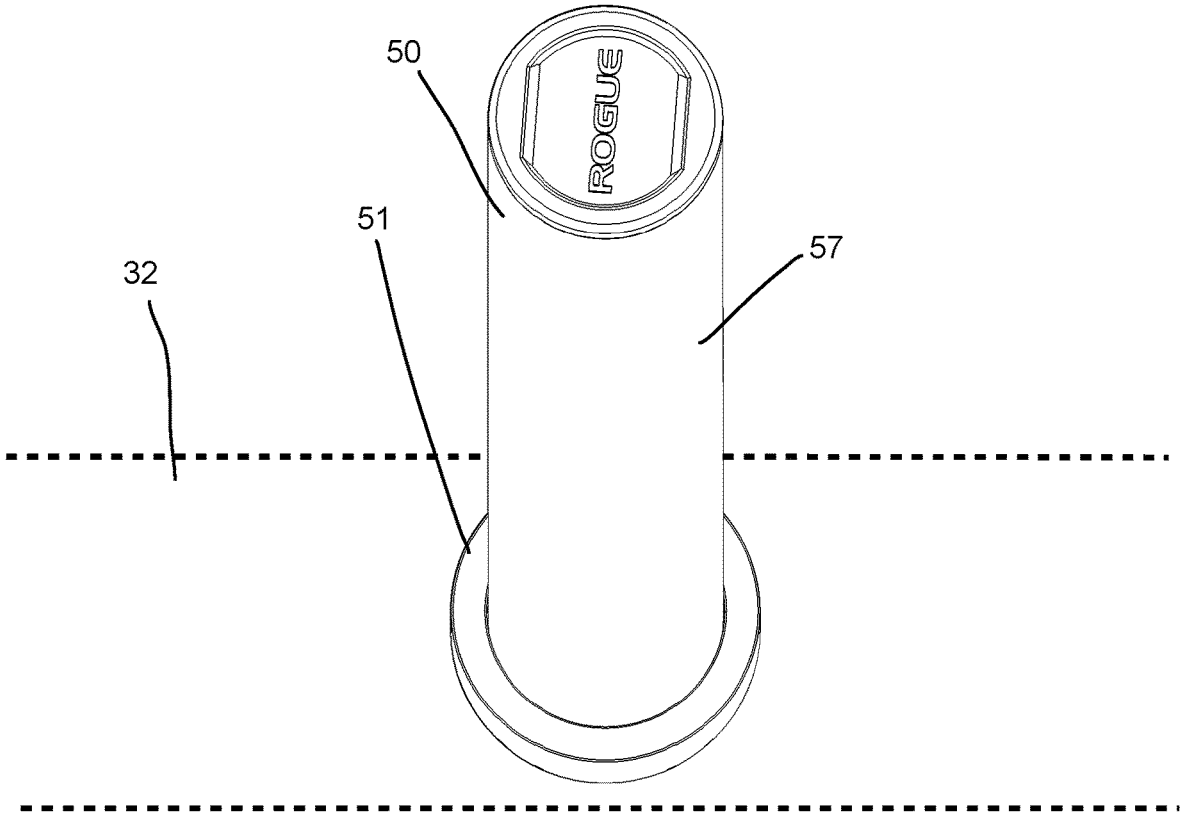
FIG. 10 is a front view of the bar of FIG. 7, shown in a second rotational position, with a portion of the base shown schematically in broken lines.
Figure 11:
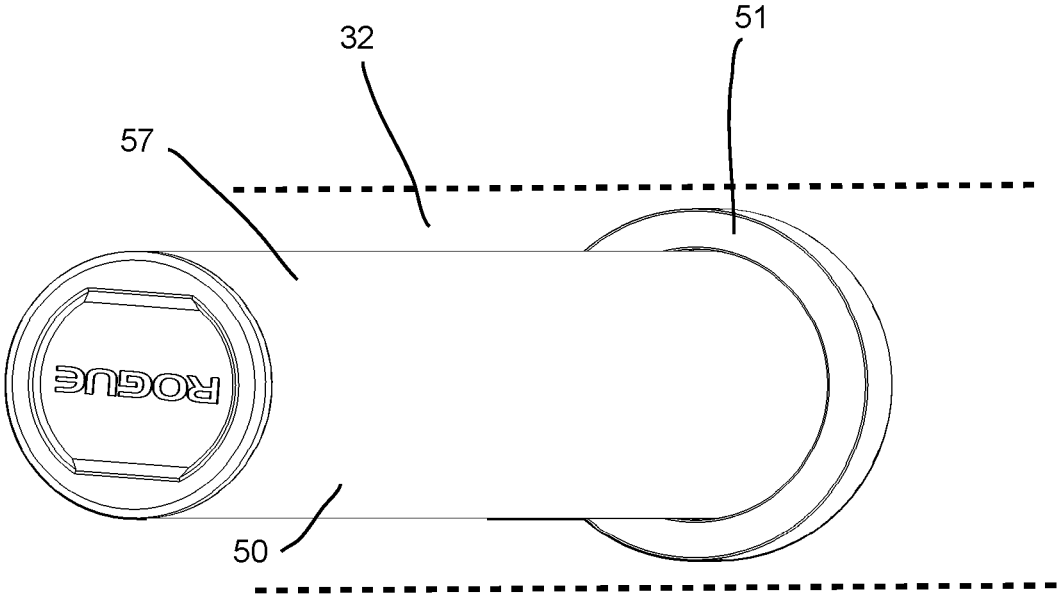
FIG. 11 is a front view of the bar of FIG. 7, shown in a third rotational position, with a portion of the base shown schematically in broken lines.
Figure 12:
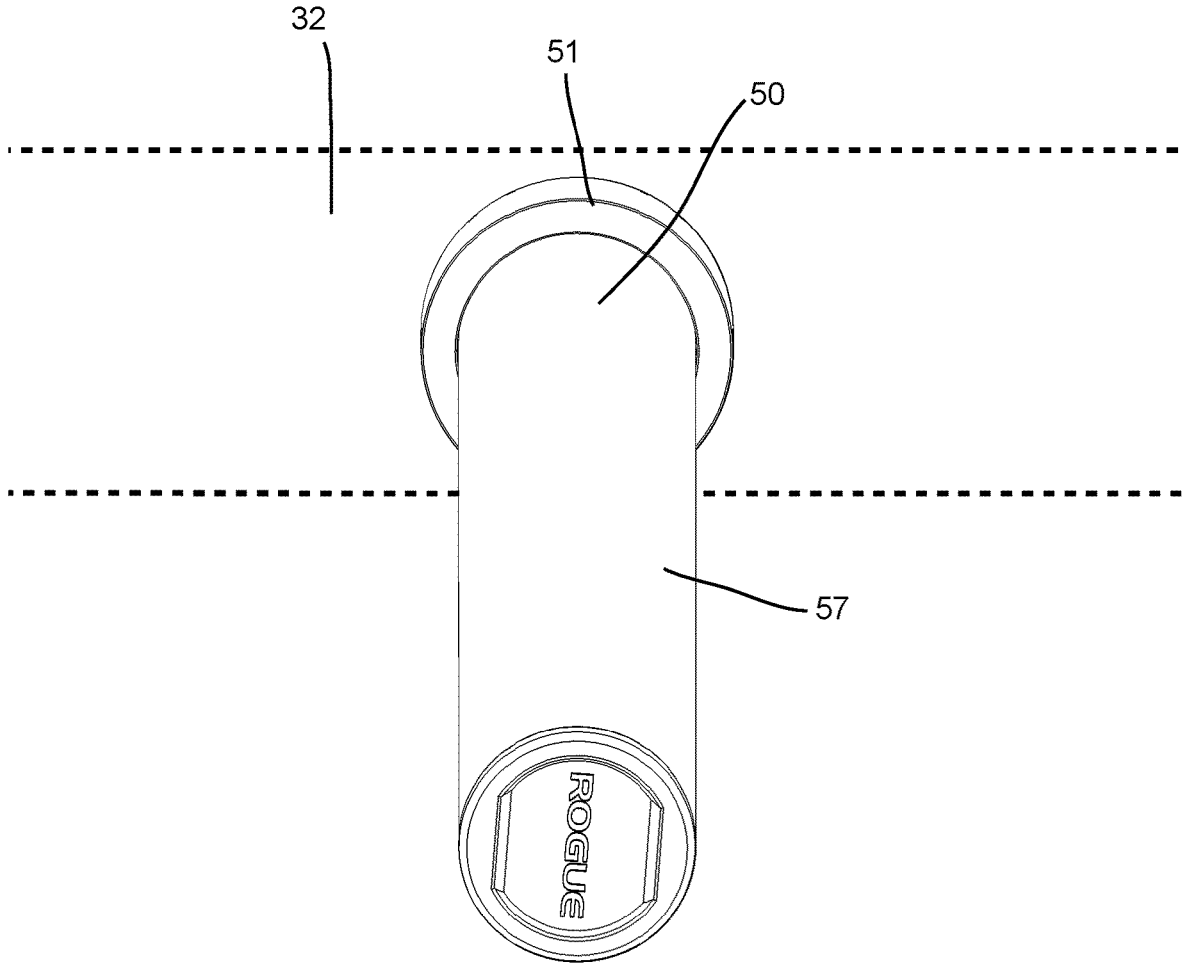
FIG. 12 is a front view of the bar of FIG. 7, shown in a first rotational position, with a portion of the base shown schematically in broken lines.

FIGS. 9-12 illustrate four different handle orientations for a handle 50 as shown in FIGS. 1-8 with the arm structure 30 of this embodiment, using four different rotational mounting positions in which the projection 55 is received in the four different positioning holes 42 surrounding the corresponding mounting hole 37. FIG. 7 illustrates one set of mounting holes 37 and positioning holes 42 of the supporting portion 22 of the apparatus 10 as shown in FIGS. 1-6. For reference, the positioning holes 42 surrounding the second mounting hole 37B in FIG. 7 are labeled 42A-D. FIG. 9 illustrates the orientation of the handle 50 of FIG. 8 when the projection 55 is received in the first positioning hole 42A in FIG. 7. In this position, the second axis B is parallel to the lateral centerline CL, i.e., the angle X is 0°. FIG. 10 illustrates the orientation of the handle 50 of FIG. 8 when the projection 55 is received in the second positioning hole 42B in FIG. 7. In this position, the angle X is 7°, and the handle 50 is angled upward at a 7° angle as well. FIG. 11 illustrates the orientation of the handle 50 of FIG. 8 when the projection 55 is received in the third positioning hole 42C in FIG. 7. In this position, the angle X is 14°. FIG. 12 illustrates the orientation of the handle 50 of FIG. 8 when the projection 55 is received in the fourth positioning hole 42D in FIG. 7. In this position, the angle X is 7°, and the handle 50 is angled downward at a 7° angle as well. Thus, FIGS. 7 and 9-12 illustrate the four different rotational positions in which the handle 50 can be positioned in the embodiment of FIGS. 1-12. It is understood that multiple projections 55 may be used for a connector 51 in another embodiment, provided that the projections 55 have the same regular spacing as the positioning holes 42.

The apparatus 10 may be placed in a storage position when not in use, as shown in FIGS. 13-14 and discussed elsewhere herein. In the storage position, the base 20 is connected to the frame member 12 using a pin 28 through the lower apertures 27B of the mounting portion 21, such that the base 20 is rotated downward relative to the use position illustrated in FIG. 1. In the storage position, the handles 50 can also be repositioned as shown in FIGS. 13-14. The handles 50 can be connected to the rear side of the arm structure 30 by inserting the shaft 54 into the mounting holes 37 on the rear surface 36 of each arm 32 and connecting the threaded knob 56 (or other fastener) on the front side of the arm structure 30. The projection 55 can be received in one of the secondary positioning holes 43 adjacent to the desired mounting hole 37 on the rear surface 36 of the arm 32. To return the apparatus 10 to the use position, the handles 50 are removed, the base 20 is rotated upward, a pin 28 is inserted through the upper apertures 27A to connect the apparatus 10 to the frame member 12, and the handles 50 are reconnected into the appropriate mounting holes 37 and positioning holes 42 to create the desired configuration.

Various embodiments of weightlifting apparatuses and attachments have been described herein, which include various components and features. In other embodiments, the weightlifting apparatuses and attachments may be provided with any combination of such components and features. It is also understood that in other embodiments, the various devices, components, and features of the weightlifting apparatuses and attachments described herein may be constructed with similar structural and functional element/s having different configurations, including different ornamental appearances.

The apparatus 10 described herein provides multiple benefits and advantages over existing dip apparatuses and other weightlifting attachments. For example, the structure provides for twelve different combinations of position and orientation for each handle 50, greatly increasing the versatility of the apparatus. As another example, the structure provides for ease of adjustment between different handle 50 orientations and positions. As a further example, the apparatus 10 can be placed in a storage position to occupy less space in the weightlifting area and avoid the necessity of disconnecting the apparatus from the weight rack and storing it separately. Still further benefits and advantages are recognizable to those skilled in the art. It is understood that the adjustable handles 50 and the corresponding mounting structures described herein can be used in connection with handles/grips for other types of weightlifting equipment and apparatuses for use in different activities.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "side," "rear," "proximal," "distal," and the like, as used herein, are intended for illustrative purposes only and do not limit the embodiments in any way. Nothing in this specification should be construed as requiring a specific three dimensional orientation of structures in order to fall within the scope of this invention, unless explicitly specified by the claims. When used in description of a method or process, the term "providing" (or variations thereof) as used herein means generally making an article available for further actions, and does not imply that the entity "providing" the article manufactured, assembled, or otherwise produced the article. The term "approximately" as used herein implies a variation of up to 10% of the nominal value modified by such term, or up to 10% of a midpoint value of a range modified by such term. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A weightlifting apparatus comprising:

a base comprising a mounting portion configured for connection to a supporting structure, a first arm and a second arm extending outward on opposite lateral sides of the mounting portion, and a connecting portion connecting the first and second arms to the mounting portion, wherein the first arm has a first mounting hole extending inward from a front side of the first arm and a plurality of first positioning holes extending inward from the front side of the first arm and positioned at different locations around the first mounting hole, and the second arm has a second mounting hole extending inward from a front side of the second arm and a plurality of second positioning holes extending inward from the front side of the second arm and positioned at different locations around the second mounting hole;

a first handle connected to the first arm and extending outward from the first arm, the first handle having a first connector configured for connection to the first arm and a first grip member extending outward from the first connector and configured for gripping by a user, wherein the first connector comprises a first shaft extending away from the first grip member and a first projection extending away from the first grip member alongside the first shaft, and wherein the first handle is adjustably connected to the first arm by the first shaft being received in the first mounting hole; and a second handle connected to the second arm and extending outward from the second arm, the second handle having a second connector configured for connection to the second arm and a second grip member extending outward from the second connector and configured for gripping by the user, wherein the second connector comprises a second shaft extending away from the second grip member and a second projection extending away from the second grip member alongside the second shaft, and wherein the second handle is adjustably connected to the second arm by the second shaft being received in the second mounting hole, wherein the first projection is configured to be received in any of the first positioning holes, and the first handle is configured to be rotationally adjustable with respect to the first arm by the first projection being moved between the first positioning holes, such that the first handle is placed in different rotational positions when the first projection is received in each of the first positioning holes, and wherein the second projection is configured to be received in any of the second positioning holes, and the second handle is configured to be rotationally adjustable with respect to the second arm by the second projection being moved between the second positioning holes, such that the second handle is placed in different rotational positions when the second projection is received in each of the second positioning holes.

2. The weightlifting apparatus of claim 1, wherein the mounting portion is configured for removable connection to the supporting structure including a vertical frame member of a weight rack, and the mounting portion includes two side walls and a front wall defining a channel configured to receive the vertical frame member.

3. The weightlifting apparatus of claim 2, wherein each of the side walls has an aperture for receiving a pin that extends through the apertures in the side walls and is further configured for extending through the vertical frame member to connect the mounting portion to the vertical frame member.

4. The weightlifting apparatus of claim 2, wherein the channel extends vertically, and wherein the mounting portion is configured to be connected to the vertical frame member in a use position, where the vertical frame member is configured to be received vertically in the channel, and a storage position, where the weightlifting apparatus is rotated downward relative to the use position.

5. The weightlifting apparatus of claim 1, wherein the connecting portion comprises two laterally spaced legs extending forward from the mounting portion to the first and second arms.

6. The weightlifting apparatus of claim 1, wherein:

the first arm further has a third mounting hole extending inward from the front side of the first arm and spaced from the first mounting hole along a length of the first arm, and a plurality of third positioning holes extending inward from the front side of the first arm and positioned at different locations around the third mounting hole, the second arm has a fourth mounting hole extending inward from the front side of the second arm and spaced from the second mounting hole along a length of the second arm, and a plurality of fourth positioning holes extending inward from the front side of the second arm and positioned at different locations around the fourth mounting hole, and wherein the first handle is also adjustably connectable to the first arm by the first shaft being received in the third mounting hole, and the first projection is configured to be received in any of the third positioning holes, and wherein the first handle is configured to be rotationally adjustable with respect to the first arm by the first projection being moved between the third positioning holes, such that the first handle is placed in different rotational positions when the first projection is received in each of the third positioning holes, and wherein the second handle is also adjustably connectable to the second arm by the second shaft being received in the fourth mounting hole, and the second projection is configured to be received in any of the fourth positioning holes, and wherein the second handle is configured to be rotationally adjustable with respect to the second arm by the second projection being moved between the fourth positioning holes, such that the second handle is placed in different rotational positions when the second projection is received in each of the fourth positioning holes.

7. The weightlifting apparatus of claim 6, wherein:

the first arm further has a fifth mounting hole extending inward from the front side of the first arm and spaced from the first mounting hole and the third mounting hole along the length of the first arm, and a plurality of fifth positioning holes extending inward from the front side of the first arm and positioned at different locations around the fifth mounting hole, the second arm has a sixth mounting hole extending inward from the front side of the second arm and spaced from the second mounting hole and the fourth mounting hole along a length of the second arm, and a plurality of sixth positioning holes extending inward from the front side of the second arm and positioned at different locations around the sixth mounting hole, and wherein the first handle is also adjustably connectable to the first arm by the first shaft being received in the fifth mounting hole, and the first projection is configured to be received in any of the fifth positioning holes, and wherein the first handle is configured to be rotationally adjustable with respect to the first arm by the first projection being moved between the fifth positioning holes, such that the first handle is placed in different rotational positions when the first projection is received in each of the fifth positioning holes, and wherein the second handle is also adjustably connectable to the second arm by the second shaft being received in the sixth mounting hole, and the second projection is configured to be received in any of the sixth positioning holes, and wherein the second handle is configured to be rotationally adjustable with respect to the second arm by the second projection being moved between the sixth positioning holes, such that the second handle is placed in different rotational positions when the second projection is received in each of the sixth positioning holes.

8. The weightlifting apparatus of claim 6, wherein the first mounting hole is positioned adjacent to the third mounting hole, and one of the first positioning holes also serves as one of the third positioning holes.

9. The weightlifting apparatus of claim 1, wherein the first shaft extends completely through the first arm, and the second shaft extends completely through the second arm, and the weightlifting apparatus further comprises:

a first fastener releasably connected to the first shaft on a rear side of the first arm to connect the first handle to the first arm; and a second fastener releasably connected to the second shaft on a rear side of the second arm to connect the second handle to the first arm.

10. The weightlifting apparatus of claim 1, wherein the first grip member is angularly offset with respect to the first shaft, such that the first grip member is oriented at different angles with respect to the first arm when the first handle is placed in the different rotational positions, and the second grip member is angularly offset with respect to the second shaft, such that the second grip member is oriented at different angles with respect to the second arm when the second handle is placed in the different rotational positions.

11. The weightlifting apparatus of claim 1, wherein the first connector further comprises a first base portion having a first abutment surface configured to confront the front side of the first arm, wherein the first grip member extends forward from the first base portion, and the first shaft and the first projection extend rearwardly from the first abutment surface, and wherein the second connector further comprises a second base portion having a second abutment surface configured to confront the front side of the second arm, wherein the second grip member extends forward from the second base portion, and the second shaft and the second projection extend rearwardly from the second abutment surface.

12. The weightlifting apparatus of claim 1, wherein the first and second arms are oriented at an oblique lateral angle to each other when viewed vertically downward.

13. A weightlifting apparatus comprising:

a base comprising a mounting portion configured for connection to a supporting structure, a first arm and a second arm extending outward on opposite lateral sides of the mounting portion, and a connecting portion connecting the first and second arms to the mounting portion, wherein the first arm has a first mounting hole extending inward from a front side of the first arm, a first positioning hole extending inward from the front side of the first arm, and a second positioning hole extending inward from the front side of the first arm, wherein the first and second positioning holes are positioned at different locations around the first mounting hole;

a first handle adjustably connectable to the first arm to extend outward from the first arm, the first handle having a first connector configured for connection to the first arm and a first grip member extending outward from the first connector and configured for gripping by a user, wherein the first connector comprises a first shaft extending away from the first grip member and a first projection extending away from the first grip member alongside the first shaft, wherein the first handle is adjustably connectable to the first arm by the first shaft being received in the first mounting hole in a first rotational position, where the first projection is received in the first positioning hole, and a second rotational position where the first projection is received in the second positioning hole, and wherein the first grip member is oriented differently in the first and second rotational positions.

14. The weightlifting apparatus of claim 13, wherein the first arm further has a third positioning hole extending inward from the front side of the first arm, wherein the first, second, and third positioning holes are positioned at different locations around the first mounting hole, and wherein the first handle is further connectable to the first arm in a third rotational position, where the first projection is received in the third positioning hole, and wherein the first grip member is oriented differently in the first, second, and third rotational positions.

15. The weightlifting apparatus of claim 14, wherein the first arm further has a fourth positioning hole extending inward from the front side of the first arm, wherein the first, second, third, and fourth positioning holes are positioned at different locations around the first mounting hole, and wherein the first handle is further connectable to the first arm in a fourth rotational position, where the first projection is received in the fourth positioning hole, and wherein the first grip member is oriented differently in the first, second, third, and fourth rotational positions.

16. The weightlifting apparatus of claim 13, wherein the first grip member is angularly offset with respect to the first shaft, such that the first grip member is oriented at different angles with respect to the first arm in the first rotational position and in the second rotational position.

17. The weightlifting apparatus of claim 13, wherein the first arm further has a second mounting hole extending inward from the front side of the first arm and spaced from the first mounting hole along a length of the first arm, a third positioning hole extending inward from the front side of the first arm, and a fourth positioning hole extending inward from the front side of the first arm, wherein the third and fourth positioning holes are positioned at different locations around the second mounting hole, wherein the first handle is further adjustably connectable to the first arm by the first shaft being received in the second mounting hole in a third rotational position, where the first projection is received in the third positioning hole, and a fourth rotational position where the first projection is received in the fourth positioning hole, and wherein the first grip member is oriented differently in the third and fourth rotational positions.

18. The weightlifting apparatus of claim 17, wherein the first arm further comprises a first mounting plate mounted on the front side of the first arm, and wherein the first mounting hole, the second mounting hole, the first positioning hole, the second positioning hole, the third positioning hole, and the fourth positioning hole all extend through the first mounting plate.

19. The weightlifting apparatus of claim 13, wherein the first shaft extends completely through the first arm, and the weightlifting apparatus further comprises:

a first fastener releasably connected to the first shaft on a rear side of the first arm to connect the first handle to the first arm.

20. A weightlifting apparatus comprising:

a base comprising a mounting portion configured for connection to a supporting structure, a first arm and a second arm extending outward on opposite lateral sides of the mounting portion, and a connecting portion connecting the first and second arms to the mounting portion, wherein the first arm has a first mounting hole extending inward from a front side of the first arm, and the second arm has a second mounting hole extending inward from a front side of the second arm;

a first handle connected to the first arm and extending outward from the first arm, the first handle having a first connector configured for connection to the first arm and a first grip member extending outward from the first connector and configured for gripping by a user, wherein the first connector comprises a first base portion having a first abutment surface configured to confront the front side of the first arm, wherein the first grip member extends forward from the first base portion, and a first shaft extending rearward from the first base portion, and wherein the first handle is adjustably connected to the first arm by the first shaft being received in the first mounting hole; and a second handle connected to the second arm and extending outward from the second arm, the second handle having a second connector configured for connection to the second arm and a second grip member extending outward from the second connector and configured for gripping by the user, wherein the second connector a second base portion having a second abutment surface configured to confront the front side of the second arm, wherein the second grip member extends forward from the second base portion, and a second shaft extending away from the second base portion, and wherein the second handle is adjustably connected to the second arm by the second shaft being received in the second mounting hole, a plurality of first positioning holes extending inward from one of the front side of the first arm and the first abutment surface of the first connector;

a first projection extending outward from the other of the front side of the first arm and the first abutment surface of the first connector;

a plurality of second positioning holes extending inward from one of the front side of the second arm and the second abutment surface of the second connector; and a second projection extending outward from the other of the front side of the second arm and the second abutment surface of the second connector;

wherein the first projection is configured to be received in any of the first positioning holes, and the first handle is configured to be rotationally adjustable with respect to the first arm by the first projection being moved between the first positioning holes, such that the first handle is placed in different rotational positions when the first projection is received in each of the first positioning holes, and wherein the second projection is configured to be received in any of the second positioning holes, and the second handle is configured to be rotationally adjustable with respect to the second arm by the second projection being moved between the second positioning holes, such that the second handle is placed in different rotational positions when the second projection is received in each of the second positioning holes.

21. The weightlifting apparatus of claim 20, wherein:

the first positioning holes extend inward from the first abutment surface of the first connector, and the first projection extends outward from the front side of the first arm, wherein the first arm further comprises a first mounting plate mounted on the front side of the first arm, and wherein the first projection is connected to the first mounting plate and extends outward from the first mounting plate, and the second positioning holes extend inward from the second abutment surface of the second connector, and the second projection extends outward from the front side of the second arm, wherein the second arm further comprises a second mounting plate mounted on the front side of the second arm, and wherein the second projection is connected to the second mounting plate and extends outward from the second mounting plate.

22. A weightlifting apparatus comprising:

a base comprising a mounting portion configured for connection to a supporting structure, a right arm and a left arm extending outward on opposite lateral sides of the mounting portion, and a connecting portion connecting the right and left arms to the mounting portion, wherein the right arm has a first right mounting hole extending inward from a front side of the right arm and a plurality of first right positioning holes extending inward from the front side of the right arm and positioned at different locations around the first right mounting hole, and a second right mounting hole extending inward from the front side of the right arm and a plurality of second right positioning holes extending inward from the front side of the right arm and positioned at different locations around the second right mounting hole, and wherein the left arm has a first left mounting hole extending inward from a front side of the left arm and a plurality of first left positioning holes extending inward from the front side of the left arm and positioned at different locations around the first left mounting hole, and a second left mounting hole extending inward from the front side of the left arm and a plurality of second left positioning holes extending inward from the front side of the left arm and positioned at different locations around the second left mounting hole;

a first handle adjustably connectable to the right arm to extend outward from the right arm, the first handle having a first connector configured for connection to the right arm and a first grip member extending outward from the first connector and configured for gripping by a user, wherein the first connector comprises a first shaft extending away from the first grip member and a first projection extending away from the first grip member alongside the first shaft; and a second handle adjustably connectable to the left arm to extend outward from the left arm, the second handle having a second connector configured for connection to the left arm and a second grip member extending outward from the second connector and configured for gripping by the user, wherein the second connector comprises a second shaft extending away from the second grip member and a second projection extending away from the second grip member alongside the second shaft, wherein the first handle is adjustably connectable to the right arm in a first position by the first shaft being received in the first right mounting hole and in a second position by the first shaft being received in the second right mounting hole, wherein the first projection is configured to be received in any of the first right positioning holes, and when the first handle is connected to the right arm in the first position, the first handle is configured to be rotationally adjustable with respect to the right arm by the first projection being moved between the first right positioning holes, such that the first handle is placed in different rotational positions when the first projection is received in each of the first right positioning holes, wherein the first projection is configured to be received in any of the second right positioning holes, and when the first handle is connected to the right arm in the second position, the first handle is configured to be rotationally adjustable with respect to the right arm by the first projection being moved between the second right positioning holes, such that the first handle is placed in different rotational positions when the first projection is received in each of the second right positioning holes, wherein the second handle is adjustably connectable to the left arm in a third position by the second shaft being received in the first left mounting hole and in a fourth position by the second shaft being received in the second left mounting hole, wherein the second projection is configured to be received in any of the first left positioning holes, and when the second handle is connected to the left arm in the third position, the second handle is configured to be rotationally adjustable with respect to the left arm by the second projection being moved between the first left positioning holes, such that the second handle is placed in different rotational positions when the second projection is received in each of the first left positioning holes, and wherein the second projection is configured to be received in any of the second right positioning holes, and when the second handle is connected to the left arm in the fourth position, the second handle is configured to be rotationally adjustable with respect to the left arm by the second projection being moved between the second left positioning holes, such that the second handle is placed in different rotational positions when the second projection is received in each of the second left positioning holes.

23. The weightlifting apparatus of claim 22, wherein the mounting portion is configured for removable connection to the supporting structure including a vertical frame member of a weight rack, and the mounting portion includes two side walls and a front wall defining a channel configured to receive the vertical frame member, wherein each of the side walls has an aperture for receiving a pin that extends through the apertures in the side walls and is further configured for extending through the vertical frame member to connect the mounting portion to the vertical frame member.

24. The weightlifting apparatus of claim 22, wherein the connecting portion comprises two laterally spaced legs extending forward from the mounting portion to the right and left arms.

25. The weightlifting apparatus of claim 22, wherein the first right mounting hole is positioned adjacent to the second right mounting hole, and one of the first right positioning holes also serves as one of the second right positioning holes, and wherein the first left mounting hole is positioned adjacent to the second left mounting hole, and one of the first left positioning holes also serves as one of the second left positioning holes.

26. The weightlifting apparatus of claim 22, wherein the first shaft extends completely through the right arm, and the second shaft extends completely through the left arm, and the weightlifting apparatus further comprises:

a first fastener releasably connected to the first shaft on a rear side of the right arm to connect the first handle to the right arm; and a second fastener releasably connected to the second shaft on a rear side of the left arm to connect the second handle to the left arm.

27. The weightlifting apparatus of claim 22, wherein the first grip member is angularly offset with respect to the first shaft, such that the first grip member is oriented at different angles with respect to the right arm when the first handle is placed in the different rotational positions, and the second grip member is angularly offset with respect to the second shaft, such that the second grip member is oriented at different angles with respect to the left arm when the second handle is placed in the different rotational positions.

* * * * *